US011408269B2

(12) United States Patent
Moreno et al.

(10) Patent No.: US 11,408,269 B2
(45) Date of Patent: Aug. 9, 2022

(54) METHODS AND DEVICES FOR STRESS, WEAR AND SUBMERGENCE MONITORING IN MECHANICALLY PUMPED DEVIATED OIL WELLS

(71) Applicant: YPF TECNOLOGÍA S.A., Ciudad Autónoma de Buenos Aires (AR)

(72) Inventors: Gustavo Ariel Moreno, Pcia. de Buenos Aires (AR); Abel Esteban Garriz, Pcia. de Buenos Aires (AR)

(73) Assignee: YPF TECNOLOGÍA S.A., Ciudad Autónoma de Buenos Aires (AR)

( * ) Notice: Subject to any disclaimer, the term of this patent is extended or adjusted under 35 U.S.C. 154(b) by 146 days.

(21) Appl. No.: 16/886,322

(22) Filed: May 28, 2020

(65) Prior Publication Data

US 2021/0002998 A1 Jan. 7, 2021

(30) Foreign Application Priority Data

May 28, 2019 (AR) ..... 20190101435

(51) Int. Cl.

| | |
|---|---|
| ***E21B 43/12*** | (2006.01) |
| ***E21B 47/009*** | (2012.01) |
| ***E21B 47/007*** | (2012.01) |
| ***E21B 19/02*** | (2006.01) |
| ***E21B 44/00*** | (2006.01) |

(52) U.S. Cl.

CPC ..... *E21B 47/007* (2020.05); *E21B 19/02* (2013.01); *E21B 43/127* (2013.01); *E21B 44/005* (2013.01); *E21B 47/009* (2020.05)

(58) Field of Classification Search

CPC ..... E21B 43/127; E21B 47/009

See application file for complete search history.

(56) References Cited

U.S. PATENT DOCUMENTS

| | | | | |
|---|---|---|---|---|
| 3,343,409 | A | 9/1967 | Gibbs | |
| 2006/0149476 | A1* | 7/2006 | Gibbs | E21B 47/009 702/6 |
| 2010/0111716 | A1 | 5/2010 | Gibbs et al. | |
| 2013/0104645 | A1 | 5/2013 | Pons | |

FOREIGN PATENT DOCUMENTS

WO WO-2010051270 A1 5/2010

OTHER PUBLICATIONS

Gibbs, S.G., "Predicting the Behavior of Sucker-Rod Pumping Systems," Society of Petroleum Engineers, Jul. 1963, pp. 769-778.

(Continued)

*Primary Examiner* — Giovanna Wright

(74) *Attorney, Agent, or Firm* — Muncy, Geissler, Olds & Lowe, P.C.

(57) ABSTRACT

Methods for monitoring and diagnosing the operation of a deviated oil well pumping system comprising sucker rod string driven by a polished rod, as well as devices for carrying out such methods, are described. The methods employ mathematical models incorporating phenomena not contemplated in the methods of the prior art, providing advantageous results for the adequate operation of a non-vertical oil well.

8 Claims, 34 Drawing Sheets

(56) References Cited

OTHER PUBLICATIONS

Everitt et al., "An Improved Finite-Difference Calculation of Downhole Dynamometer Cards for Sucker-Rod Pumps," Society of Petroleum Engineers, Feb. 1992, pp. 121-127.
Lukasiewicz, S.A., "Dynamic Behavior of the Sucker Rod String in the Inclined Well," Society of Petroleum Engineers, 1991, pp. 313-321.
Humphreys et al., "Reciprocating-Sliding Wear of Sucker Rods and Production Tubing in Deviated Oil Wells," Wear, vol. 134, 1989, pp. 13-28.

* cited by examiner

METHODS AND DEVICES FOR STRESS, WEAR AND SUBMERGENCE MONITORING IN MECHANICALLY PUMPED DEVIATED OIL WELLS

TECHNICAL FIELD OF THE INVENTION

The present invention refers to the technical field of oil production. Specifically, the present invention refers to a hybrid prediction-diagnosis model and method for monitoring stress propagation, installation wear rate and submergence in mechanically pumped oil-producing wells, as well as devices utilizing such method having an autonomous, compact and economical design.

TECHNOLOGICAL BACKGROUND

In an oil production process, well controllers are used to automatically monitor and control the operation of individual pumping devices in order to optimize the operation of the downhole pump.

The basic principles of measurement and operation of well controllers, described for example in U.S. Pat. No. 3,343,409, include the calculation of the downhole dynamometric card. This calculation involves solving equations to model the propagation of elastic stresses along structures inside the well from the bottom to the surface (see S. G. Gibbs. Predicting the Behavior of Sucker-Rod Pumping Systems, Journal of Petroleum Technology 15 issue 07 (1963), SPE-588-PA).

Dynamometry in vertical oil wells has been addressed since Sam Gibbs' first publications, where a mathematical model based on local quantity-of-motion balance equations was established for the elaboration of dynamometric cards (see S. G. Gibbs. op. cit.). The differential equations of the model have been solved numerically using different algorithms (S. G. Gibbs Rod Pumping: Modern Methods of Design, Diagnosis, and Surveillance; T. A. Everitt and J. W. Jennings, An Improved Finite-Difference Calculation of Downhole Dynamometer Cards for Sucker-Rod Pumps, SPE Production Engineering 7 issue 1 (1992) SPE-18189-PA.) and are currently employed in the control methods of most commercially available well controllers (see for example GE-Lufkin SAM, Weatherford Well Pilot, among others). Gibbs' mathematical model comprises a differential equation in partial derivatives with terms of acceleration and viscous dissipation, the latter being linearly dependent on speed.

In the case of non-vertical, deviated or directional wells, where the trajectory of same cannot be approximated by a vertical line, the normal stresses of the tubing on the string and, consequently, the Coulomb friction, should be incorporated into the mathematical models in order to consider the friction phenomena that originate forces in opposite directions to those of the movement of the string. Since their dependence on speed is not linear, they cannot be included within the dissipation terms of Gibbs' equation. For this reason, the solution to the dynamometric problem using a mathematical model based on Gibbs' equation for vertical wells cannot be applied, or represents only an approximation.

Patent application US 2010/111716 A1 describes the inclusion of Coulomb friction based on an approximate calculation and an iterative method, which requires an initial estimation of the lateral stresses. As a consequence of such approximate calculation, it is not possible to determine the normal stresses dynamically, nor to include certain important aspects of the phenomenology, for example the possibility that the string is temporarily stopped due to the existence of compatible static solutions during certain time intervals near the dead points (or points of return). Thus, this "stucking effect" is not considered in the prior art.

Patent application US 2013/0104645 A1 describes a method for calculating downhole cards for deviated wells based on a mathematical model proposed by Lukasiewicz (S. A. Lukasiewicz, Dynamic Behavior of the Sucker Rod String in the Inclined Well, Production Operations Symposium, Apr. 7-9, 1991) which, in addition to incorporating the axial movement of the string, takes into account its transverse displacement and the propagation of transverse vibrations in the tubing. Such vibrations in turn may be partially inhibited due to contact with the tubing, which may occur only in some portions of the trajectory and only in some directions (e.g. on a single side of the tubing). The general solution to the coupled system of model equations is extremely complex and, in many cases, unnecessary, since the magnitudes of interest associated with axial displacement do not require a solution involving transverse vibrations in a general way. This fact is especially clear in the case of a vertical well where initially transverse waves could also propagate, where Gibbs' purely axial solution gives an excellent approximation in the cases of practical interest. The method proposed in US 2013/0104645 A1 also implies an iterative resolution.

None of these prior art documents describes or suggests the use of calculation methods for the diagnosis of deviated wells nor do they discuss the stability or numerical difficulties of the proposed algorithms.

Patent application WO 2010/051270 A1 describes stress calculations in pumping systems using a finite difference method in an Everitt-Jennings type algorithm. In this context, solving the model equations in "diagnostic mode" results in the propagation of numerical errors that are amplified as the stresses are calculated at positions closer to the downhole pump. In the specific case of deviated wells, the amplification of these errors is even more notorious due to the discontinuity of the Coulomb friction and requires a method of regularization that is not described in the prior art. These numerical difficulties are manifested, in particular, as peaks of limited magnitude in the calculated bottom force, generating "false information" that must be filtered.

On the other hand, as the string is in contact with the tubing, wear of both components will occur. Although the theory of wear is applicable to general systems, there is little information regarding the specific case of mechanical pumping components. References show that, in addition to the dependence on the normal contact force, wear increases significantly with the pumping speed in these cases (see P. L. Ko, K. Humphreys and C. Matthews. Reciprocating-sliding wear of sucker rods and production tubing in deviated oil wells, Wear, 134 (1989) 13-28). For this reason, even though there is no extensive laboratory information that enables predicting wear in a given operating condition, the dynamic regime of such components must be adequately characterized to correlate it with the performance detected in the field, being eventually possible to use this characterization to distinguish the source of problems in wells with failures due to wear.

One of the uncharacterized dynamic effects in the state of the art is the existence of local static solutions as the string approaches dead ends, i.e. the extreme positions of the string where the sign of the speed is reversed. These events will be called, hereinafter, string stucking events. Specifically, at the times when the average speed is very close to zero, and at a point in the string that approaches the zero speed condition, it may occur that the configuration of the string elements is locally compatible with static balance, that is, that a static balance condition of the physical-mathematical model is verified. Then, when one of these elements stops (i.e. has a zero speed), it will be stopped until the static balance condition generated by friction is no longer verified. In this situation, that portion of the string, after having reached the condition of zero speed, will remain motionless or stuck, until the imbalance of axial forces is sufficiently great to "break" such balance condition. For this reason, some points, segments, or even the entire string may remain stuck once or several times during a pumping cycle. At the intervals at which this occurs, these points will not have a relative displacement to the tubing and will remain in static mechanical contact until the local balance condition is broken. These events may improve the surface adherence mechanism and consequently increase the wear of the components of the pumping system. Therefore, their characterization and understanding are fundamental to the design of a mechanical pumping system in a directional or deviated well.

The aforementioned dynamic states, which involve both static and dynamic solutions, are not considered in the methods of the prior art for this specific problem of the oil industry, even though they provide an advantageous position for the study of possible wear effects.

Therefore, there is a need to provide a method that enables considering the behavior of axial displacement of the rod string of a mechanical pumping system in the mathematical models and algorithms involved, taking into account the actual well trajectory and the interaction between the string and the tubing, so as to estimate the string dynamics, predict forces and displacements at downhole without additional hypotheses or approximations and the method being numerically robust. At the same time, the model and method must consider the existence of stucking points at certain time intervals, as well as their effects on the pumping system.

BRIEF DESCRIPTION OF THE INVENTION

The present invention makes it possible to solve the disadvantages of the prior art by incorporating phenomena not contemplated in the previously known methods, as well as advantageous resolution schemes that provide results of interest for the monitoring of non-vertical oil wells.

In a first aspect, it is an object of the present invention a method to determine the stress profile in a pumping system of an oil well comprising a sucker rod string driven by a polished rod, depending on the axial position of the sucker rod string, where the method comprises the following steps:

a) obtaining a measurement of the position of the polished rod at the surface, b) obtaining a measurement of the force on the downhole pump, c) calculating the value of the force on the polished rod at the surface by numerically solving a system of equations representative of the pumping system in a natural generalized coordinates system using measurements of the position of the polished rod at the surface and the force on the downhole pump, d) calculating the stresses at each axial position of the sucker rod string from the measurement of the force on the downhole pump and the value of the force on the polished rod at the surface as calculated in step c), and e) associating to each stress calculated in step (d) the corresponding axial position of the sucker rod string in order to obtain the stress profile.

In a preferred embodiment, the system of equations representative of the pumping system in a natural generalized coordinates system is the system of equations {(15), (16)}:

$$m_i \frac{d^2 s_i}{dt^2} = \vec{f}_{r,i}^{\,+} \cdot \hat{\tau}_i + \vec{f}_{r,i}^{\,-} \cdot \hat{\tau}_i + m_i \vec{g} \cdot \hat{\tau}_i + \vec{f}_i^{\,c} \cdot \hat{\tau}_i + \vec{f}_i^{\,v} \cdot \hat{\tau}_i + \vec{f}_i^{\,p} \cdot \hat{\tau}_i \quad (i = 1, 2, \ldots, N) \tag{15}$$

$$0 = \vec{f}_{r,i}^{\,+} \cdot \hat{n}_i + \vec{f}_{r,i}^{\,-} \cdot \hat{n}_i + m_i \vec{g} \cdot \hat{n}_i + \vec{N}_i \quad (i = 1, 2, \ldots, N) \tag{16}$$

wherein for each of the elements i:

$s_i(t)$ is the generalized coordinate corresponding to the center position of the element, t is a time variable, $m_i$ is the mass of the element, $\vec{f}_{r,i}^{\,+}$ is the elastic force exerted on the element by the i+1 neighbor element, $\vec{f}_{r,i}^{\,-}$ is the elastic force exerted on the element by the i−1 neighbor element, $\hat{\tau}_i$ is the tangential versor at the point $s_i(t)$, $\vec{g}$ is the acceleration vector of the gravitational field, $\vec{f}_i^{\,c}$ is the Coulomb force exerted on the element, $\vec{f}_i^{\,v}$ is the viscous force exerted on the element, $\vec{f}_i^{\,p}$ is the force exerted on the element due to changes in the cross section, $\vec{N}_i$ is the normal force exerted on the element, and $\hat{n}_i$ is the normal versor at the point $s_i(t)$.

In a preferred embodiment, there is at least one element i for which the relationship (18) and the equation (17) are verified simultaneously:

$$\frac{ds_i}{dt} \neq 0 \tag{18'}$$

$$\vec{f}_i^{\,c} = -\mu_d |N_i| \operatorname{sign}\left(\frac{ds_i}{dt}\right) \hat{\tau}_i \tag{17}$$

wherein $\mu_d$ is the dynamic friction coefficient and where the sign function is given by the equation (25):

$$\operatorname{sign}(x) = \begin{cases} 1 \text{ if } x > a \\ x/a \text{ if } -a \leq x \leq a \\ -1 \text{ if } x < -a \end{cases} \tag{25}$$

wherein $\alpha$ is a real number.

In another preferred embodiment, there is at least one element i and a value of force $\vec{f}_i^{\,*c}$ for which equations (23), (20) and (21) and the in equation (22) are verified simultaneously:

$$\frac{ds_i}{dt} = 0 \tag{23}$$

$$0 = \vec{f}_{r,i}^{+} \cdot \hat{\tau}_i + \vec{f}_{r,i}^{-} \cdot \hat{\tau}_i + m_i \vec{g} \cdot \hat{\tau}_i + \vec{f}_i^{*c} \cdot \hat{\tau}_i + \vec{f}_i^{p} \cdot \hat{\tau}_i \tag{20}$$

$$0 = \vec{f}_{r,i}^{+} \cdot \hat{n}_i + \vec{f}_{r,i}^{-} \cdot \hat{n}_i + m_i \vec{g} \cdot \hat{n}_i + N_i \tag{21}$$

$$|\vec{f}_i^{*c}| \leq \mu_e |N_i| \tag{22}$$

wherein $\mu_e$ is the coefficient of static friction.

In a preferred embodiment, the method also comprises the steps of:

f) comparing the axial stress profile obtained in step (e) with a reference axial stress profile; and g) modifying an operational parameter of the pumping system based on the comparison made in step f).

In a preferred embodiment, the method also comprises the calculation of the cycle work of the pumping system.

In another preferred embodiment, the method also comprises the calculation of the number of stucking events for each point in the sucker rod string per pumping system cycle.

In a second aspect, it is an object of the present invention a method for diagnosing the operation of an oil well pumping system comprising a sucker rod string driven by a polished rod, where the method comprises the following steps:

a) obtaining a measurement of the position of the polished rod at the surface, b) obtaining a measurement of the force on the polished rod at the surface, c) calculating the value of the force on the downhole pump by numerically solving a system of equations representative of the pumping system in a natural generalized coordinates system using the measurements of the position of the polished rod and the force on the polished rod at the surface, d) obtaining a diagnosis of the operation of the pumping system from the value of the downhole force calculated in step c).

In a preferred embodiment, step c) of calculating the value of the downhole force comprises finding the zero of the R function defined by the equation (32):

$$R(s_{i+1}(t)) = -m_i \frac{d^2 s_i}{dt^2} = \vec{f}_{r,i}^{+} \cdot \hat{\tau}_i + \vec{f}_{r,i}^{-} \cdot \hat{\tau}_i + m_i \vec{g} \cdot \hat{\tau}_i + \vec{f}_i^{c} \cdot \hat{\tau}_i + \vec{f}_i^{v} \cdot \hat{\tau}_i + \vec{f}_i^{p} \cdot \hat{\tau}_i \quad (i = 1, 2, \ldots, N-1) \tag{32}$$

wherein for each of the elements i:

$s_i(t)$ is the generalized coordinate corresponding to the center position of the element, t is a time variable, $m_i$ is the mass of the element, $\vec{f}_{r,i}^{+}$ is the elastic force exerted on the element by the i+1 neighbor element, $\vec{f}_{r,i}^{-}$ is the elastic force exerted on the element by the i−1 neighbor element, $\hat{\tau}_i$ is the tangential versor at the point $s_i(t)$, $\hat{g}$ is the acceleration vector of the gravitational field, $\vec{f}_i^{c}$ is the Coulomb force exerted on the element, $\vec{f}_i^{v}$ is the viscous force exerted on the element, $\vec{f}_i^{p}$ is the force exerted on the element due to changes in the cross section.

In a more preferred embodiment, equation (37) is verified:

$$s_N(t) = \sum_{k=-M}^{k<M} \widehat{s_{N,k}} e^{j\omega_k t} \tag{37}$$

wherein M is a number of elements included in the sum, $\widehat{s_{N,k}}$ are the coefficients of a truncated Fourier series development of the function $s_N(t)$ that minimize the objective function O defined by equation (38):

$$O = \sum_l \left(F_l - F_l^{pred}[\widehat{s_{N,k}}]\right)^2 + \alpha \sum_l \left(f_l^{(d)} - f_{l+1}^{(d)}\right)^2 \quad (l = 1, 2, 3, \ldots, T) \tag{38}$$

wherein $F_l$ is the value of the force on the polished rod at time $t_l$ obtained by measuring the force on the polished rod at the surface, $F_l^{pred}[\widehat{s_{N,k}}]$ is the force on the polished rod obtained in step c) of the method of the first aspect of the invention, using the coefficients $\widehat{s_{N,k}}$ according to equation (37), $\alpha$ is a noise minimization factor, and $f_l^{(d)}$ is the downhole force at the time $t_l$ obtained from step c) of the method of the second aspect of the invention.

In a yet more preferred embodiment, step d) of obtaining an operation diagnosis of the pumping system from the value of the force on the downhole pump comprises determining the pressure at the pump inlet $p_I$ from equation (36):

$$p_I = p_D - \frac{f_0}{A_B} \tag{36}$$

wherein $f_0$ is the range of force of the downhole card obtained from step c) of the method of the second aspect of the invention, $p_D$ is the pressure at the pump discharge, and $A_B$ is the area of the pump.

Regarding the first aspect, it is an object of the present invention a device for monitoring the operation of an oil well pumping system comprising a sucker rod string driven by a polished rod, where said device comprises, in a single housing or enclosure:

at least one data acquisition unit, at least one source of energy and at least one processing unit, where said data acquisition unit obtains a measurement of the polished rod position at the surface and a measurement of the force on the downhole pump, and said processing unit calculates the value of the force on the polished rod at the surface by numerically solving a system of equations representative of the pumping system in a natural generalized coordinates system using the measurements of the polished rod position at the surface and the force on the downhole pump.

Regarding the second aspect, it is an object of the present invention a device for monitoring the operation of an oil well pumping system comprising a sucker rod string driven by a polished rod, where said device comprises, in a single housing or enclosure:

at least one data acquisition unit, at least one source of energy and at least one processing unit, where said data acquisition unit obtains a measurement of the polished rod position at the surface and a measurement of the force on the polished rod at the surface and said processing unit enables calculating of the value of the force on the downhole pump by numerically solving a system of equations representative of the pumping system in a natural generalized coordinates system using the measurements of the polished rod position and the force on the polished rod at the surface.

BRIEF DESCRIPTION OF THE DRAWINGS

FIG. 21A shows the surface card of the S-shaped well with partially filled pump in black, and in gray the fitting result given by the hybrid model. FIG. 21B shows the condition of the predictive model (black dotted line), downhole card inferred by the diagnostic mode (gray solid line) and downhole card inferred by the hybrid method (black solid line).

In FIGS. 22A and 22B different pumping speeds are used.

DETAILED DESCRIPTION

Figure 1:
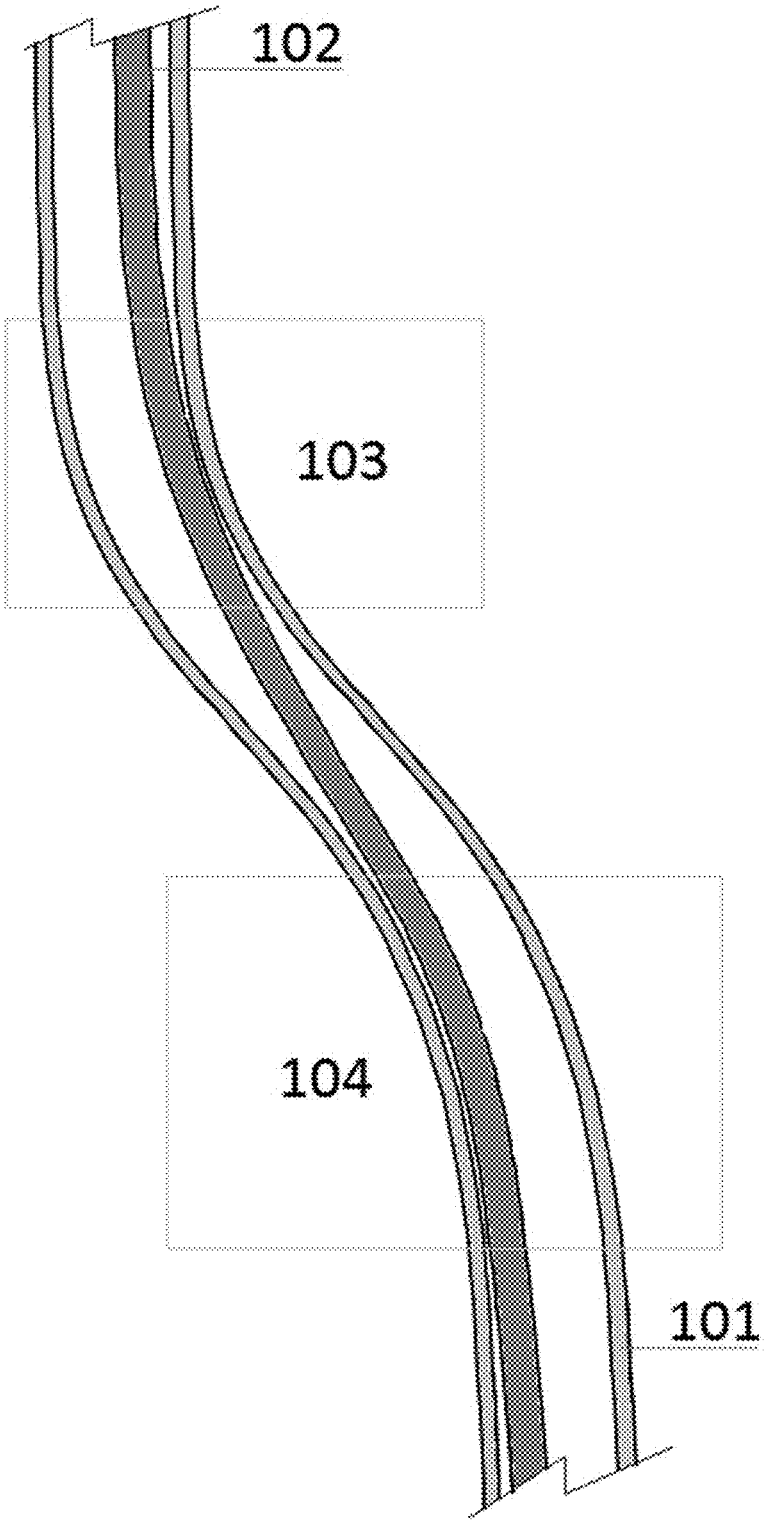
FIG. 1 shows a schematic representation of a deviated oil well.

The present invention will be described in more detail below, with reference to the accompanying figures.

As used herein, the term "monitoring" refers to the collection of values of system variables and the establishment of relationships between them on some medium, for example in the form of a report, table, card or computer file, so as to enable the automated control using well controller devices that implement the methods of the present application.

In the present application, the expression "independent pumping equipment or pumpjack refers to mechanical pumping equipment used in the production of oil wells, comprising an engine, a gearbox and a force transmission unit which, through periodic oscillatory movements, enables a string of sucker rods to be pulled to drive a downhole pump.

The term "card", or alternatively the expression "dynamometric card" refers to a graphic representation of the force at a point in the sucker rod string regarding the position of same with time as a parameter. The dynamometric card can be "surface" or "bottom" depending on whether it corresponds to the stresses on the polished rod (surface card) or on the downhole pump (downhole card). The dynamometric card can also be calculated at intermediate points of the string, at an arbitrary depth, in which case it is not given a particular name, but its depth is referred to specifically in that case.

As used in the present, the expression "to evolve variables" refers to the calculation of values of variables that represent physical magnitudes at a given moment in time from the values of such variables at a previous moment in time. Such calculation can be carried out by implementing a numerical method through an algorithm.

The term "submergence" is used to refer to the difference in hydrostatic charge between the pump depth and the level of dynamic fluid above the pump. Submergence is generally expressed in units of height, and corresponds to the length of the liquid column in the annulus above the pump.

The expression "pump hitting" refers to the possible pump hit against the upper or lower seat when the pump is close to the upper or lower dead points. A pump hitting occurs intentionally on some occasions, and in other occasions because of an improper spacing between the polished rod and the crossarm that mechanically connects it to the pumpjack. The expression "fluid shock" refers to the impact that the pump piston makes against the fluid when the barrel has been incompletely filled and the travelling valve has not been opened at the start of the downwards stroke. The expression "filled pump" refers to operation when the barrel is completely filled and the pump is operating normally.

The methods of the present invention use mathematical models that enable the description of the pumping string discreetly and the characterization of its axial movement in a system of natural generalized coordinates given by the arc length measured from the surface for a specific position of a moving element. In this way, it is automatically verified that each element in the string moves over the set of points that define the trajectory of the well. This approach can be called Lagrangian, since it does not start from a differential equation in partial derivatives, but specifically follows the evolution of the elements.

In general, such mathematical models are based on local balances of quantity of movement and consist of systems of ordinary non-linear differential equations.

The models employed in the present invention can be used either in "predictive mode" or in "diagnostic mode", depending on the boundary conditions under which the differential equations of the involved mathematical models are solved.

When the system is solved by specifying a mixed boundary condition, such as the surface position, and a ratio for specifying the downhole force, such as, in the case of a filled pump, a constant and negative load value on the downward stroke and constant and positive on the upward stroke, the method operates in "predictive mode": from the solution of the equations, the force on the well surface can be estimated by specifying a condition on the downhole pump.

In "diagnostic mode", the stationary state of the system, periodically pumped at the surface, is considered. In this case, the boundary conditions correspond to values at the surface, usually measured by a dynamometer (load cell) and a position transducer, and downhole values are obtained by solving the equations of the mathematical model.

The model utilized in the present invention can be used in both "diagnostic mode" and "predictive mode", implementing specific numerical methods for each of these modes associated with different boundary conditions in the model, as will be expressed in detail later in the present.

For the resolution of equations in the diagnostic mode, the methods of the prior art use algorithms based on the Everitt-Jennings algorithm. Said algorithm presents numerical problems in systems that include dynamic Coulomb friction phenomena, due to the discontinuous nature of the corresponding terms in the model equations.

Although an alternative is to regularize these discontinuities, for example by approximating the dynamic Coulomb friction with a continuous function, this regularization cannot be applied to the stucking problem described above.

In the present invention, a hybrid prediction-diagnosis method is described for the use of the method of the present invention in "diagnostic mode". Said hybrid method is based on the numerical stability inherent to the "predictive mode" method and consists of an iterative calculation of the coefficients of the Fourier series development of the downhole dynamometric card, so as to minimize the difference between the value of a surface operating characteristic obtained by the method in "predictive mode" and the measured value of said surface operating characteristic at the surface.

Additionally, by using the method of the present invention, it is possible to incorporate effects not contemplated in the methods of the prior art into the mathematical models and solve the equations of the model in a numerically stable manner.

In addition to the card downhole card, the methods of the present invention enable the evaluation of wear models depending on depth, incorporating effects ignored in the prior art. Furthermore, by using this same model, variables critical in the definition of the operating state, such as the fluid pressure at the pump inlet or, similarly, the submergence, can be calculated. Such magnitudes will enable a diagnosis on whether the well is well or poorly exploited, for example if the well has a submergence lower than 200 m it will typically be considered well exploited. If the submergence is close to zero, a condition of fluid level depletion, it will generate an incomplete filling of the pump, resulting in fluid shock.

Advantageously, the monitoring methods of the present invention have a simpler implementation from the numerical point of view. Secondary hypotheses are not formulated, such as those relating to the transverse motion in order to calculate lateral stresses, which enables simpler and possibly faster implementations on the same computing platform, such as a microcontroller. Additionally, the methods of the present invention can be applied to oil wells to which the methods of the prior art could not be applied, where the stucking effects are not considered in the formalism.

The aspects related to the numerical stability of the algorithms used in the methods of the present invention, as well as their advantages with respect to the methods of the prior art, will be described in detail in the exemplary embodiments below, with references to the accompanying figures.

Unlike the methods in the prior art, where the problem of the propagation of numerical errors is not discussed, in the present invention it is detailed how to control the same, and methods that enable the correction of the effects generated in the typical schemes are introduced. These methods additionally enable incorporating phenomenology not taken into account in the prior art, such as the stucking of the string near the upper and lower dead points.

The typical geometry of a deviated oil well is shown in FIG. 1. Due to the tortuosity of the well, string 102 will enter into contact with the tubing 101 in the areas of greatest curvature, such as zones 103 and 104, remaining under tension. Since the aspect ratio between the radius of the tubing and its length is very small (of the order of 1:100,000), for the model associated with the present invention a one-dimension movement of the string is considered, following exactly the trajectory of the tubing. That is, it is assumed that the string moves according to a trajectory given by:

$$X(s)=(x(s),y(s),z(s)) \tag{1}$$

being s a generalized coordinate representing the arc length measured from the wellhead (ground level) and x, y, z the cartesian coordinates of the one-dimension trajectory.

Such trajectory, defined a priori, is the tubing path, equivalent to the well path. The string is represented by a set of N elements or "particles" which length in relaxation is $l_0$.

By definition, the only degree of freedom of the elements is the position of their mass center (or geometrical center), represented by the generalized coordinate $s_i(t)$, which is the arc length from the wellhead to the center of the i-th element. Thus, the position of such element in cartesian coordinates is:

$$\vec{x}_i(t)=(x_i(t),y_i(t),z_i(t)) \ (i=1,2,\ldots,N) \tag{2}$$

and therefore, it can be calculated according to:

$$\vec{x}_i(t)=X(s_i(t) \ (i=1,2,\ldots,N) \tag{3}$$

That is, the position of the i-th element at a given time is calculated by evaluating the trajectory in the generalized coordinate that unequivocally describes the movement of the element at that same time. The mathematical model used in the present invention is obtained by posing the equations of motion for this particles system, including all relevant interactions (forces).

In this case, these interactions are the elastic force between the elements, their weight, the normal reaction of the tubing necessary to keep the particle moving in the fixed trajectory, the viscous drag force representing the interaction of the elements with the surrounding fluid, the Coulomb force between the string and the tubing and the net force on each element due to the pressure field of the fluid within the tubing. Any other force is neglected for being smaller in comparison to the other terms. The only non-trivial contributions that an expert in production engineering could additionally include would be: the tendency of the string to hold straight (i.e. bending force) and the tendency of the pressure to further compress the curvature arc (i.e. circumferential force).

Analyzing the typical parameters in the problems of interest, where the curvature radius is of the order of 1000 m, it is possible to confirm that it is not necessary to consider terms representing such elastic bending effects or such lateral pressure effects due for being smaller in relation to the other terms. In the cases analyzed below, the bending terms generate corrections lower than 1/100,000 and the pressure terms due to curvature generate corrections lower than 2/100. Moreover, using the teachings of the present invention, these effects could be incorporated into the mathematical model without representing an excessive burden for an expert in the technical area.

Figure 2:
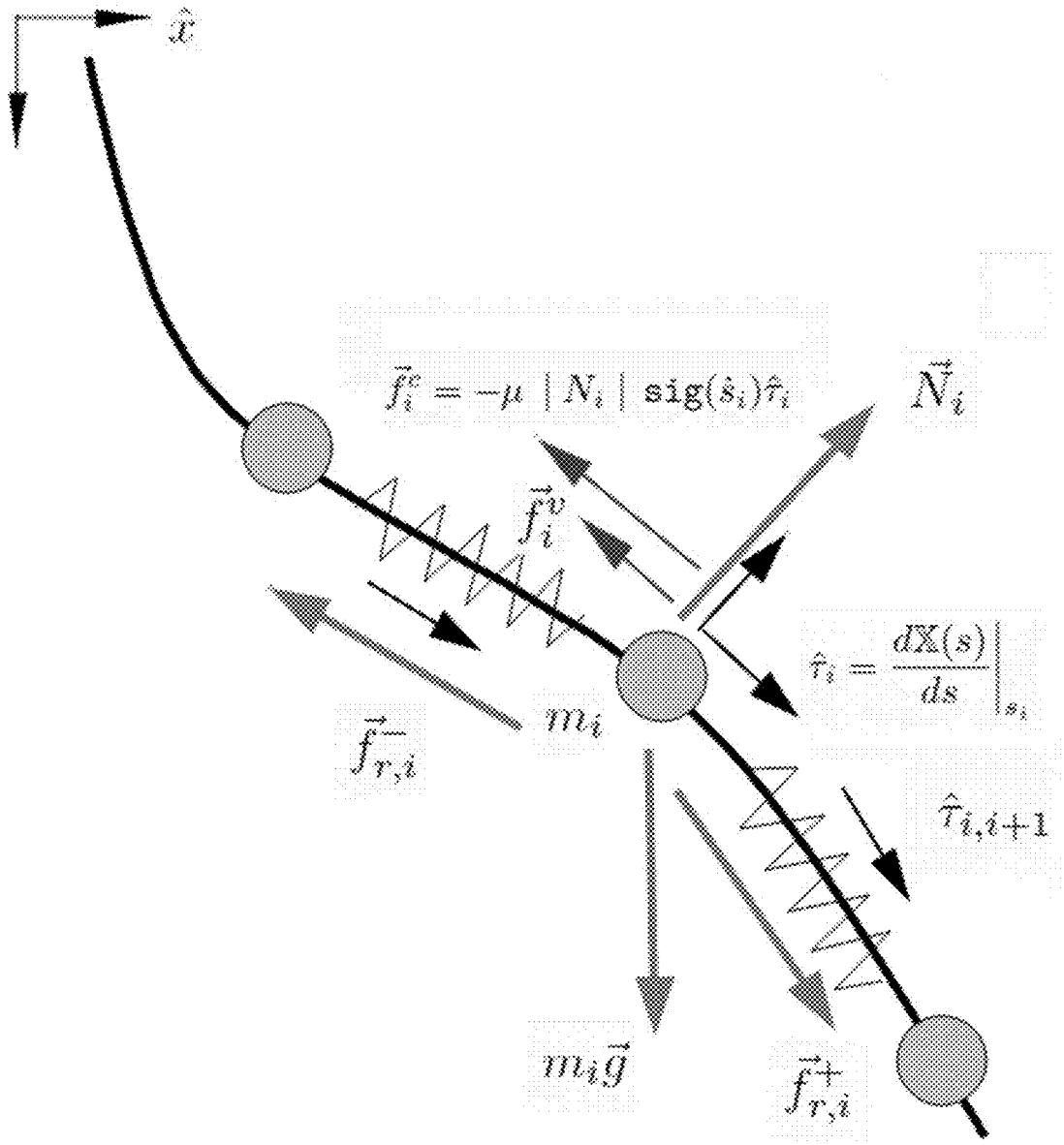
FIG. 2 shows a schematic representation of the isolated body diagram that is used to generate a mathematical model based on balance equations, where the generalized coordinates and the isolated body diagram are displayed, which enables writing the ordinary equations for the system of elements that make up the sucker rod string description.

Therefore, the model of the present invention representing the string is equivalent, from the practical point of view, to an elastic cord subject to moving along a predefined trajectory, with the exception of some section changes which generate additional force terms on the elements at the position of the discontinuity of the cross section. The elements and forces acting on each of them are represented in FIG. 2. There, the mass of each element is given by:

$$m_i=\rho A_i l_0 \ (i=1,2,\ldots,N) \tag{4}$$

where $A_i$ is the cross-sectional area at that point, p is the density of the string and $l_0$ is the relaxed length (with no external forces applied) of the element. The elastic force between adjacent elements is mediated by the elastic constant, defined according to:

$$k_i = \frac{2EA_iA_{i+1}}{l_0(A_i + A_{i+1})} \ (i = 1, 2, \ldots, N) \tag{5}$$

where E is Young's module of the sucker rod. To define the direction of the forces, a set of versors that accompany the particles. is built at each moment in time Hereinafter, the discussion will be limited to the case where the trajectory is contained in one plane. The extension to the three-dimensional case will result evident to an expert in the technical area.

In this case, the versors $\hat{\tau}_i$ y $\hat{n}_i$ are, respectively, the tangential and normal versors to the trajectory at the $s_i(t)$ point. On the other hand, the elastic force on each element is approximated by its secant. The secant versor $\hat{\tau}_{i,i+1}$ has the direction of the segment that links $X(s_i(t))$ with $X(s_{i+1}(t))$, with (i=1, 2, . . . , N) and is a valid approximation when the number of elements N in the partition is large enough to approximate the curved trajectory by a polygonal chain. In most situations of practical interest, the partition usually comprises about 100 elements, or more. It can be confirmed that the number of elements is adequate by redefining the partition with a larger number of elements and checking the convergence of the model. In this approximation, the elastic force that the i+1-th element performs on the i-th element in this approach is:

$$\vec{f}_{r,i}^{+}=-k_i(l_{i,i+1}-l_0)\hat{\tau}_{i,i+1}\ (i=1,2,\ldots,N) \tag{6}$$

as also shown in FIG. 2. Here the $l_{i,i+1}$ length is calculated explicitly, using the generalized coordinates of the neighbor elements:

$$l_{i,i+1}=\|X(s_{i+1}(t))-X(s_i(t))\|\ (i=1,2,\ldots,N) \tag{7}$$

In addition, versors are also defined by these same generalized coordinates:

$$\hat{\tau}_{i,i+1}=\frac{X(s_{i+1}(t))-X(s_i(t))}{l_{i,i+1}}\quad (i=1,2,\ldots,N) \tag{8}$$

Analogous expressions can be obtained for the i−1-th neighbor.

In this way, it is possible to pose the quantity-of-motion balance equations for each element in terms of these generalized coordinates and the systems of versors previously defined:

$$m_i\frac{d^2\vec{x}_i(t)}{dt^2}=\vec{f}_{r,i}^{+}+\vec{f}_{r,i}^{-}+m_i\vec{g}+\vec{N}_i+\vec{f}_i^{c}+\vec{f}_i^{v}+\vec{f}_i^{p}\quad (i=1,2,\ldots,N) \tag{9}$$

Here $\vec{f}_{r,i}^{+}$ y $\vec{f}_{r,i}^{-}$ are the elastic force terms of the i+1 and i−1 neighbor elements, is the weight of the i-th element, being $\vec{g}$ the acceleration vector of gravity, $\vec{N}_i$ is the normal force, $\vec{f}_i^{c}$ is the Coulomb force, $\vec{f}_i^{v}$ is the viscous force, and $\vec{f}_i^{p}$ is the net force due to section changes made by the pressure of the surrounding fluid in the tubing.

The viscous force $\vec{f}_i^{v}$ can be represented by:

$$\vec{f}_i^{v}=-\beta\dot{s}_i\vec{\tau}_i\ (i=1,2,\ldots,N) \tag{10}$$

where β is a constant that quantifies the effects of viscous dissipation.

The strength of the pressure term $\vec{f}_i^{p}$ on the i-th element can be written as:

$$\vec{f}_i^{p}=p(s_i)(A_{i+1}-A_i)\Theta(A_{i+1}-A_i)\vec{\tau}_i+p(s_i)(A_i-A_{i+1})\vec{\tau}_i\quad (i=1,2,\ldots,N) \tag{11}$$

where Θ is the Heaviside step function and $p(s_i)$ is the hydrostatic pressure of the surrounding fluid in the tubing.

Equation (9) can be used to find the equation of motion of the generalized coordinates $s_i(t)$. For such purpose, it should be noted that:

$$\frac{d^2\vec{x}_i(t)}{dt^2}=X''(s_i)\left(\frac{ds_i}{dt}\right)^2+X'(s_i)\frac{d^2s_i}{dt^2}\quad (i=1,2,\ldots,N) \tag{12}$$

This expression links cartesian acceleration to generalized speed and acceleration. Given its smallness (under typical conditions, this term is of the magnitude order of g/1000, g being the acceleration of gravity) the centrifugal term $$\left(\frac{ds_i}{dt}\right)^2$$

can be depreciated, which is quadratic in speed, and therefore, remembering that:

$$\hat{\tau}_i=\frac{dX}{ds}\Big|_{s_i}\quad (i=1,2,\ldots,N) \tag{13}$$

the equation is obtained:

$$m_i\frac{d^2s_i}{dt^2}\hat{\tau}_i=\vec{f}_{r,i}^{+}+\vec{f}_{r,i}^{-}+m_i\vec{g}+\vec{N}_i+\vec{f}_i^{c}+\vec{f}_i^{v}+\vec{f}_i^{p}\quad (i=1,2,\ldots,N) \tag{14}$$

When projecting these equations according to the versors $\vec{\tau}_i$ y $\vec{n}_i$, the following closed system of equations is obtained to calculate the temporal evolution of the generalized coordinates:

$$m_i\frac{d^2s_i}{dt^2}=\vec{f}_{r,i}^{+}\cdot\hat{\tau}_i+\vec{f}_{r,i}^{-}\cdot\hat{\tau}_i+m_i\vec{g}\cdot\hat{\tau}_i+\vec{f}_i^{c}\cdot\hat{\tau}_i+\vec{f}_i^{v}\cdot\hat{\tau}_i+\vec{f}_i^{p}\cdot\hat{\tau}_i\quad (i=1,2,\ldots,N) \tag{15}$$

$$0=\vec{f}_{r,i}^{+}\cdot\hat{n}_i+\vec{f}_{r,i}^{-}\cdot\hat{n}_i+m_i\vec{g}\cdot\hat{n}_i+N_i\quad (i=1,2,\ldots,N) \tag{16}$$

Equation (16) defines the value of the normal force in terms of a given configuration of the string elements, i.e. the set of generalized coordinates $s_i(t)$. Such equation, introduced in equation (15), defines the equation of evolution of the elements. Strictly, for the system to be well defined, it is necessary to know how to evaluate the Coulomb friction term $\vec{f}_i^{c}$.

In the prior art, only the situation in which the elements have non-zero speed is discussed. In this situation, it is possible to model the term Coulomb using its simplest expression:

$$\vec{f}_i^{c}=-\mu_d|N_i|\mathrm{sign}\left(\frac{ds_i}{dt}\right)\hat{\tau}_i\quad (i=1,2,\ldots,N) \tag{17}$$

where sign(x) is the sign function, and $\mu_d$ is the dynamic coefficient of friction. That is, the friction force is proportional to the modulus of the normal $|N_i|$ and acts in the opposite direction (sense) to the movement, with an independent value of the speed module.

Sometimes this expression is sufficient to describe the system. However, its implementation does not enable contemplating the possibility of static solutions that are compatible with the configuration at a given moment in time. This means that it is possible that the string gets stuck, in which case the previous formula is no longer valid and the correct description would consist of an in equation, which must be verified together with the condition of static balance:

$$\frac{ds_i}{dt} = 0 \ (i = 1, 2, \ldots, N) \tag{18}$$

$$\frac{d^2 s_i}{dt^2} = 0 \ (i = 1, 2, \ldots, N) \tag{19}$$

The correct description of the temporal evolution of the system, including the phenomenology of static and dynamic friction, is the following: if at one moment in time the speed of the i-th particle is not zero, the set of equations {(15), (16), (17)} must be used to make the variables evolve using some numerical method, as will be shown below. But if the speed is null, it must be verified if there is a value $\vec{f}_i^{*c}$ that solves the system of equations:

$$0=\vec{f}_{r,i}^{+}\cdot\hat{\tau}_i+\vec{f}_{r,i}^{-}\cdot\hat{\tau}_i+m_i\vec{g}\cdot\hat{\tau}_i+\vec{f}_i^{*c}\cdot\hat{\tau}_i+\vec{f}_i^{P}\cdot\hat{\tau}_i \ (i=1,2,\ldots,N) \tag{20}$$

$$0=\vec{f}_{r,i}^{+}\cdot\hat{n}_i+\vec{f}_{r,i}^{-}\cdot\hat{n}_i+m_i\vec{g}\cdot\hat{n}_i+N_i \ (i=1,2,\ldots,N) \tag{21}$$

under the restriction $$|\vec{f}_i^{*c}|\leq\mu_e|N_i| \ (i=1,2,\ldots,N) \tag{22}$$

where $\mu_e$ is the coefficient of static friction. If such value exists $\vec{f}_i^{*c}$, there is a static friction force compatible with balance, and therefore the evolution equations for the i-th element will be:

$$\frac{ds_i}{dt} = 0 \ (i = 1, 2, \ldots, N) \tag{23}$$

$$\frac{d^2 s_i}{dt^2} = 0 \ (i = 1, 2, \ldots, N) \tag{24}$$

However, if there is no solution $\hat{f}_i^{*c}$, the i-th particle must be evolved again with the set {(15), (16), (17)}. In this case, as the particle will move immediately after being stopped, the way to regularize the sign function at the origin will not impact the dynamics of the system. In general, to consider both the predictive and the diagnostic problem, the regularization of the sign function given by the following will be taken:

$$\operatorname{sign}(x) = \begin{cases} 1 & \text{if } x > a \\ x/a & \text{if } -a \leq x \leq a \\ -1 & \text{if } x < -a \end{cases} \tag{25}$$

where $\alpha$ is a dimensionless parameter hereinafter called "sign factor". The results obtained to interpret the well measurements, or system design experiments will be in the limit $\alpha\rightarrow 0$, i.e. convergence must be properly verified. As indicated above, any limited extension of the sign function will be useful for the predictive case. The model described herein, which is perfectly defined from the mathematical point of view, can be solved initially in a direct or reverse way (that is, both in predictive and diagnostic mode) by means of different methods, such as those that will be described later herein.

Predictive Mode

To solve the model in predictive mode (typically known as "direct model"), a boundary condition must be specified at each end of the string. Generally, at the surface the position of the polished rod is known based on the time S(t), for this can be deduced from the kinematics of the device. Downhole, however, a condition is imposed on the forces acting on the pump $F_{pump}$, for this condition can be inferred from the expected pressure values for the well and its operating characteristic (e.g. "filled pump", "fluid shock", etc.).

The solution of the system of equations describing the movement of the string enables the evaluation of the resulting force at the surface and the loads on the rods, and is therefore an essential tool for the design of the pumping installation.

Figure 3:
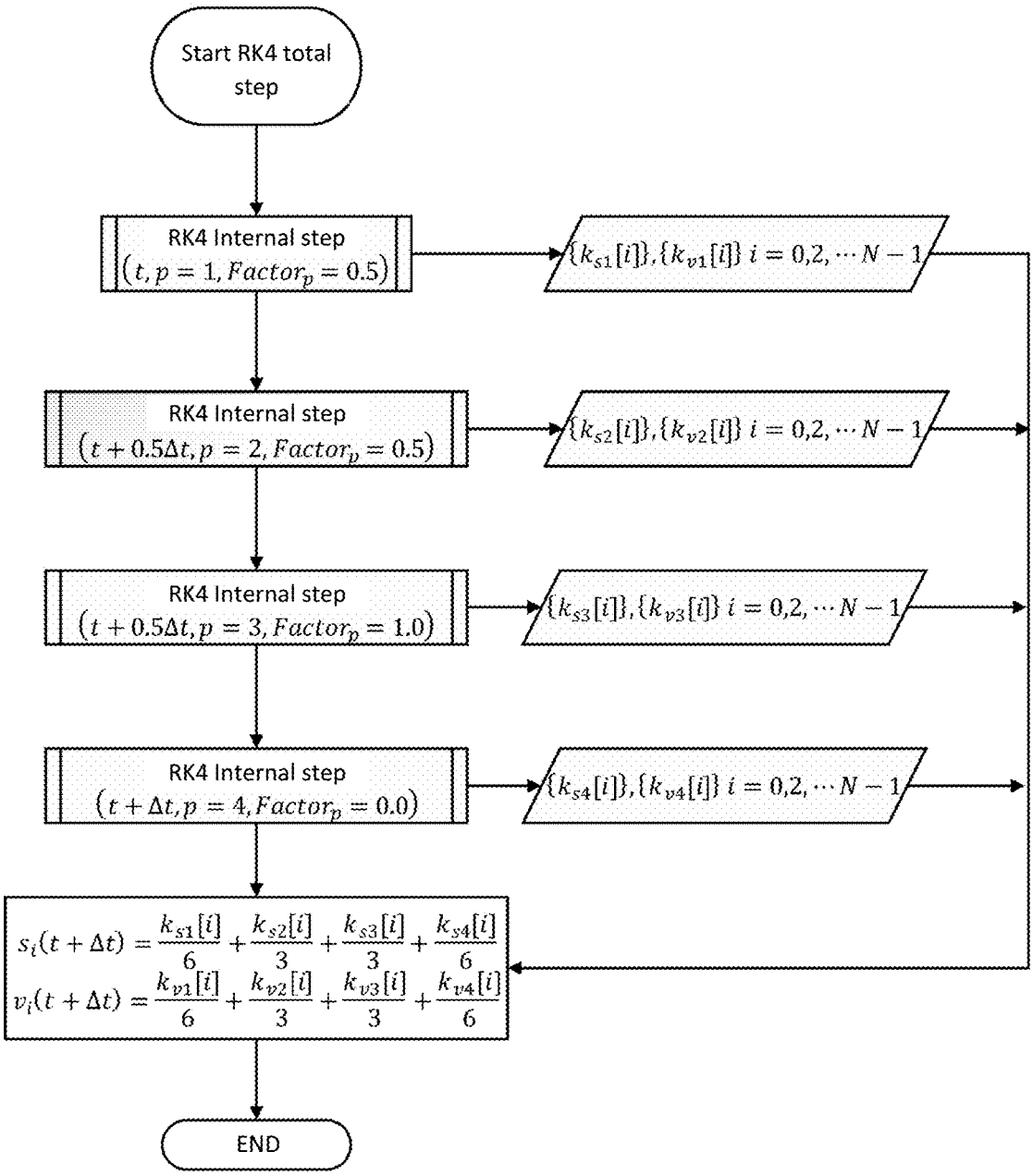
FIG. 3 shows a flow chart of a Runge-Kutta algorithm of order 4 used to solve the system of equations in predictive mode.

To make the system evolve according to the algorithm in FIG. 3, which implements a Runge-Kutta method of order 4 (RK4), two "phantom nodes" $s_{-1}(t)$ y $s_N(t)$ are defined as:

$$s_{-1}(t)=S(t)-l_0 \tag{26}$$

$$s_N(t)/\vec{f}_{r,N-1}^{+}=k_{N-1}(l_{N-1,N}-l_0)\vec{\tau}_{N-1,N} \tag{27}$$

so that S(t) y $F_{pump}=\vec{f}_{r,N-1}^{+}\cdot\vec{\tau}_{N-1,N}$ have predetermined values. The ghost particle $s_{-1}$ copies the polished rod position S(t) and there is displaced upwards in one element.

The predictive problem is a problem at initial values or Cauchy problem, that is, the position and speed of each element must be specified at the initial moment:

$$s_i(0)=S_i\forall i\in[0,N-1] \tag{28}$$

$$\dot{s}_i=V_i\forall i\in[0,N-1] \tag{29}$$

Figure 4A:
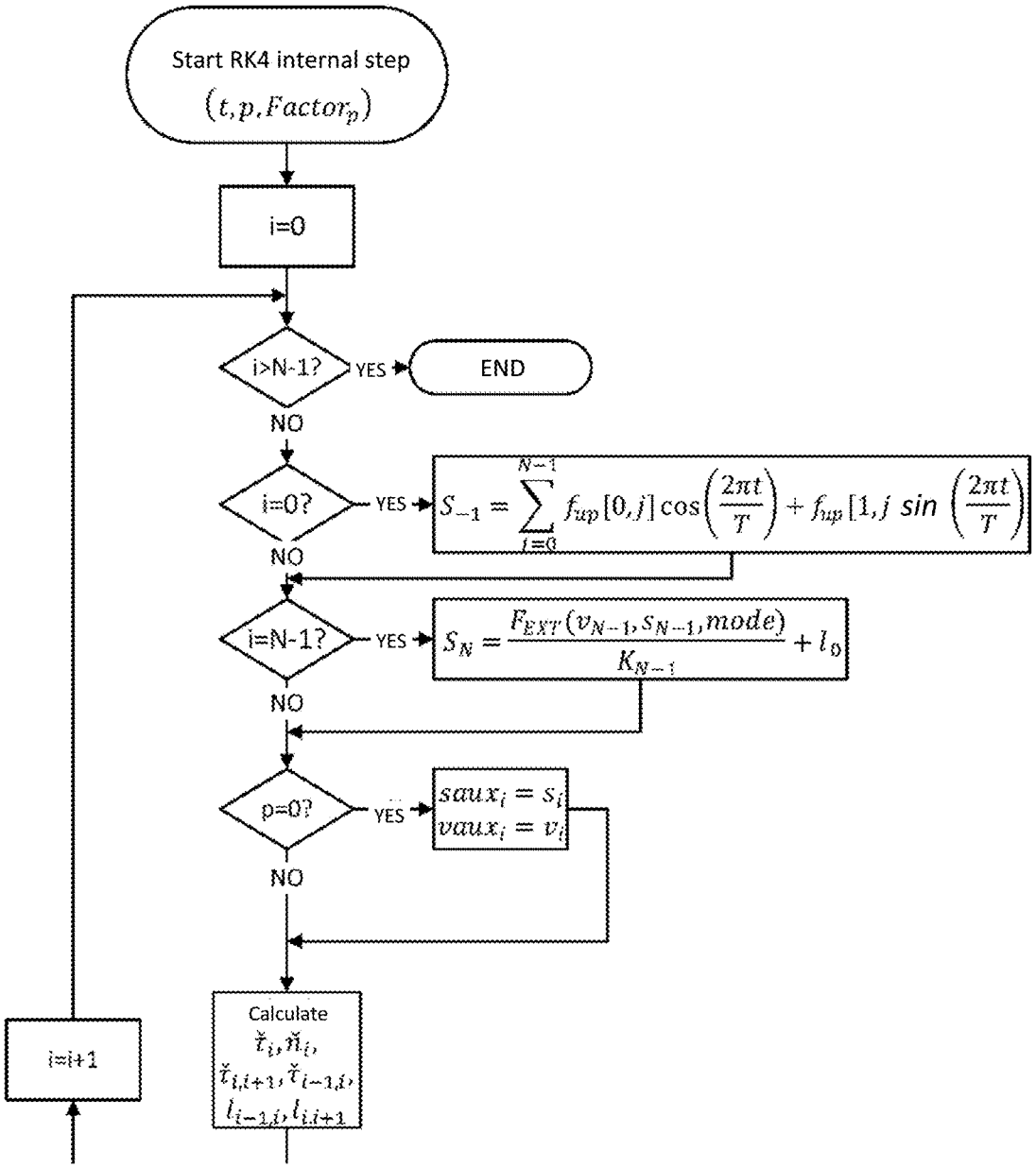
FIGS. 4A and 4B show a flow chart of the internal step associated with the Runge-Kutta algorithm of order 4 used to solve the system of equations in predictive mode.
Figure 4B:
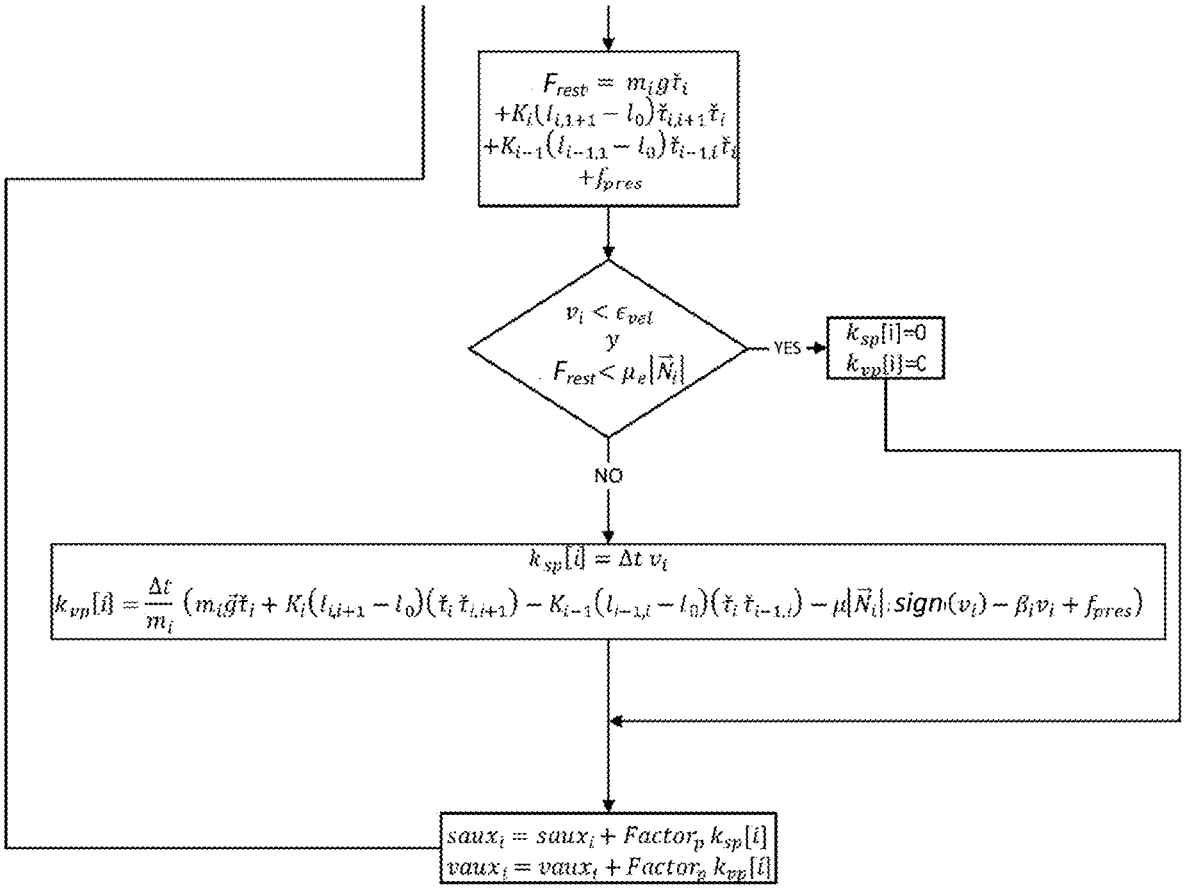

These conditions and the dynamic equations determine all further evolution of the system. The evolution algorithm, as shown in FIGS. 3, 4A and 4B, enables the evolution to be numerically calculated. At each time step and intermediate steps of the RK4 method, the system of versors required for the projection must be calculated. When the trajectory information is a discrete set of points, the missing points may be interpolated using some analytical expression. In a preferred embodiment of the present invention, such interpolation is performed using natural cubic splines.

Figure 5A:
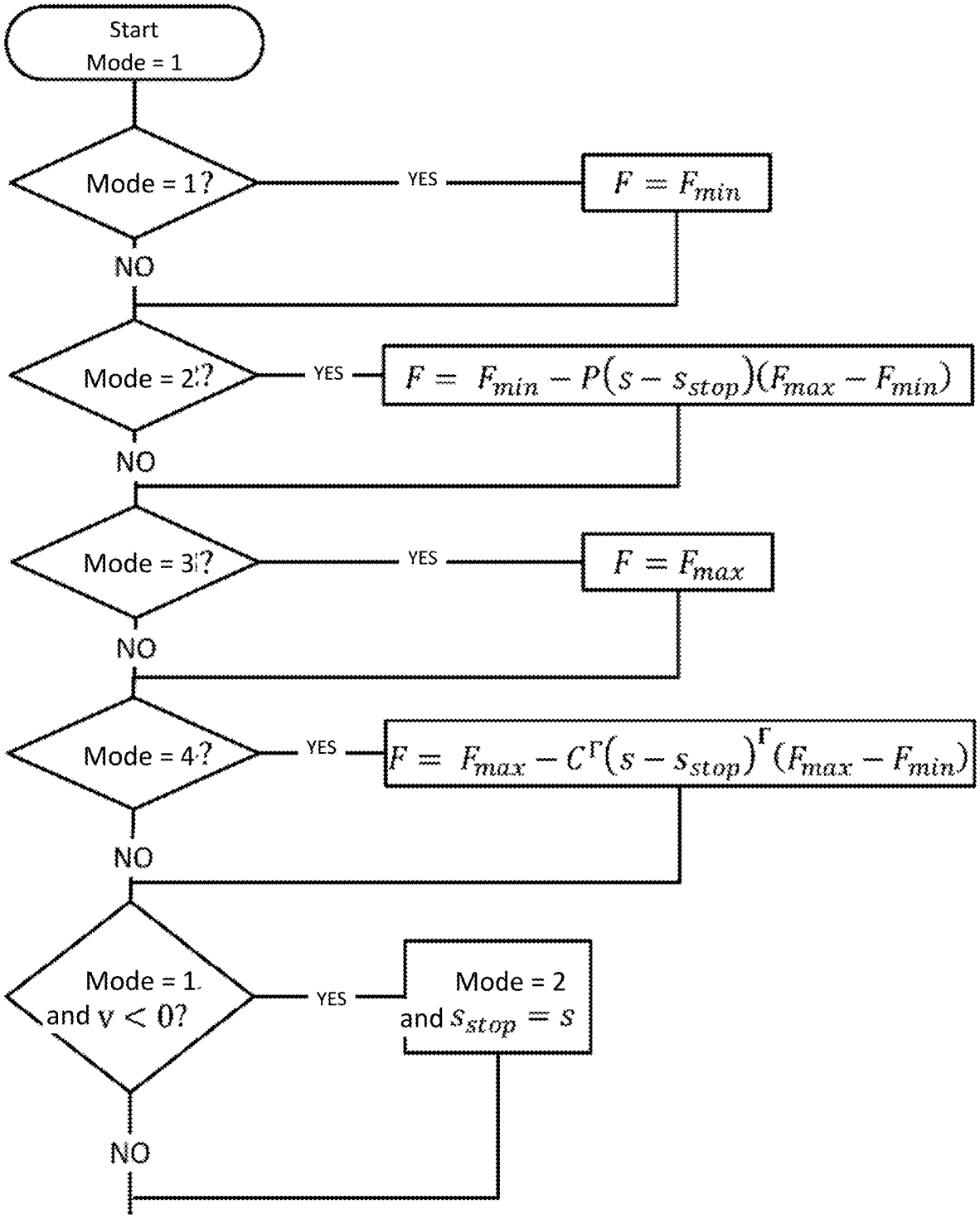
FIGS. 5A and 5B show a flow chart for implementing the boundary condition on the pump when the predictive method is used.
Figure 5B:
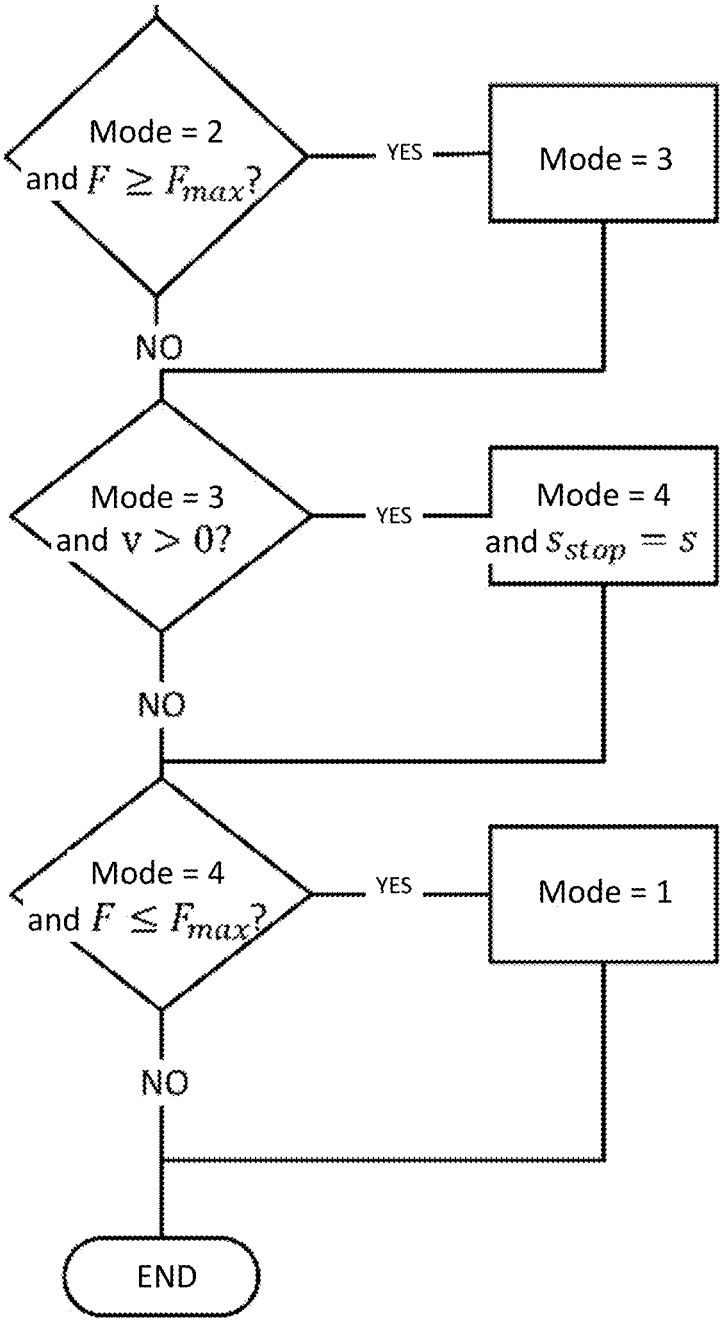

The force in the pump $F_{pump}$ is generally chosen in such a way as to represent the situation of interest for the design of the pumping device. Generally, the case of "filled pump" and "fluid shock" will be tested as indicated below, with force values determined by the pressure at the pump inlet and discharge. FIGS. 5A and 5B show an algorithm to implement this boundary condition when the RK4 method is executed.

The method in predictive mode enables estimating physical magnitudes relevant to the system and to study their evolution.

In order to analyze the wear of the installations, it is interesting to consider some magnitudes of interest, such as the maximum normal force per cycle that the string experiences at each point, the work done by the Coulomb friction force in a pumping cycle and the number of stucking events that each string element experiences during a pumping cycle.

The maximum normal force per cycle experienced by each string element is defined as $$N_i^{max} = \max_{t_0<t<t_0+P} |N_i| \tag{30}$$

Where P is the period of the pumping cycle and $t_0$ is any time after reaching the condition of periodic movement.

The total work done by the friction force during a pumping cycle is given by $$W_i = -\int_{t_0}^{t_0+P} \vec{f}_i^{\,c} \cdot \hat{\tau}_i \dot{s}_i(t)dt \tag{31}$$

The number of stucking events per cycle for each of the elements is calculated by adding the amount of time intervals in which such element has zero speed and meets the static balance conditions of equations (20), (21) and (22). These time intervals can have a variable duration.

The following examples will illustrate the type of analysis of interest for the design of an artificial oil well lifting system.

Figure 9A:
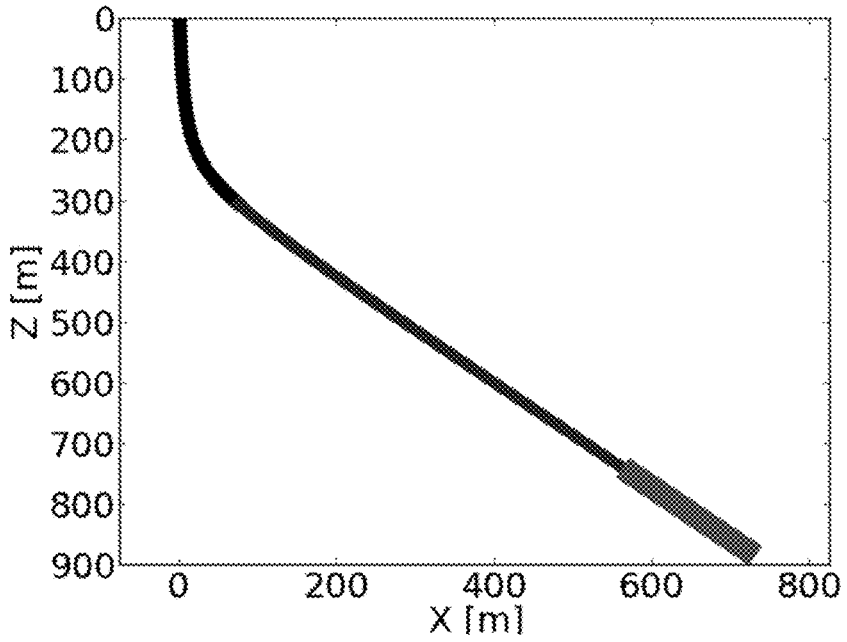
FIG. 9A shows the trajectory of a J-shaped deviated well.
Figure 10A:
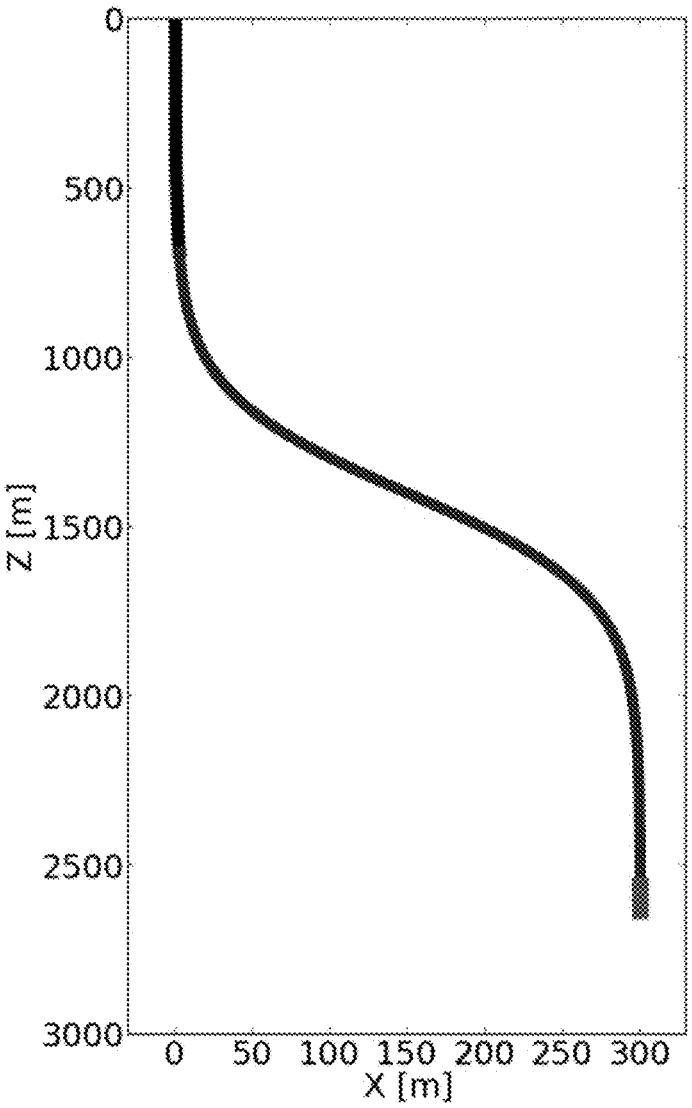
FIG. 10A shows the trajectory of a S-shaped deviated well.

FIGS. 9A and 10A show the exemplary trajectories for the calculation, corresponding to typical geometries of deviated J-shaped and S-shaped wells, respectively. The following examples were constructed using the parameters of Table 1, where $\gamma$ is the non-dimensional dissipation factor ($\beta=m_i\gamma/T$ where $T=L/c$ y $c^2=E/\rho$, being L the total length of the string), $p_L$ is the pressure on the line at the wellhead, $\rho_L$ is the density of the fluid in the tubing. In a first approximation, an average density can be taken. The changes required for the general case with more than one component in the tubing will be evident for an expert in the technical area. N is the number of elements in which the string is discretised, and the dimensional time step is $\Delta t=T/(N\ dt2dim)$ with dt2dim being a non-dimensional factor so that dt2dim>1, in order to ensure the convergence of the numerical method.

TABLE 1

Numerical parameters used in the examples

| Property [units] | J Well | S Well |
|---|---|---|
| Young's module [N/m] | $2.1\ 10^{11}$ | $2.1\ 10^{11}$ |
| Dissipation factory $\gamma$ | 0.07 | 0.2 |
| String density [kg/m$^3$] | 7850 | 7850 |
| Line pressure [kg/cm$^2$] | 5 | 10 |
| Fluid density [kg/m$^3$] | 995 | 950 |
| Length of string stretch 1 [m] | 320.04 | 688 |
| Length of string stretch 2 [m] | 670.56 | 1920 |
| Length of string stretch 3 [m] | 190.5 | 76 |
| Diameter of string stretch 1 [m] | ⅞ | ⅞ |
| Diameter of string stretch 2 [m] | ¾ | ¾ |
| Diameter of string stretch 3 [m] | $1^{1/2}$ | $1^{1/8}$ |
| $\mu_d$ string stretch 1 | 0.15 | 0.2 |
| $\mu_d$ string stretch 2 | 0.15 | 0.2 |
| $\mu_d$ string stretch 3 | 0.15 | 0.2 |
| N | 200 | 250 |
| $I_0$ [m] | 5.935 | 10.779 |
| Dt2dim | 20 | 25 |
| T [s] | 0.228356 | 0.518929 |
| $\Delta t$ [μs] | 57 | 83 |
| Trajectory dimension | 1224 | 2636 |
| Card dimension | 200 | 200 |
| $\alpha$ | 0 | 0.05 |

The analysis for other particular cases will be very similar for the expert in production engineering.

Figure 9B:
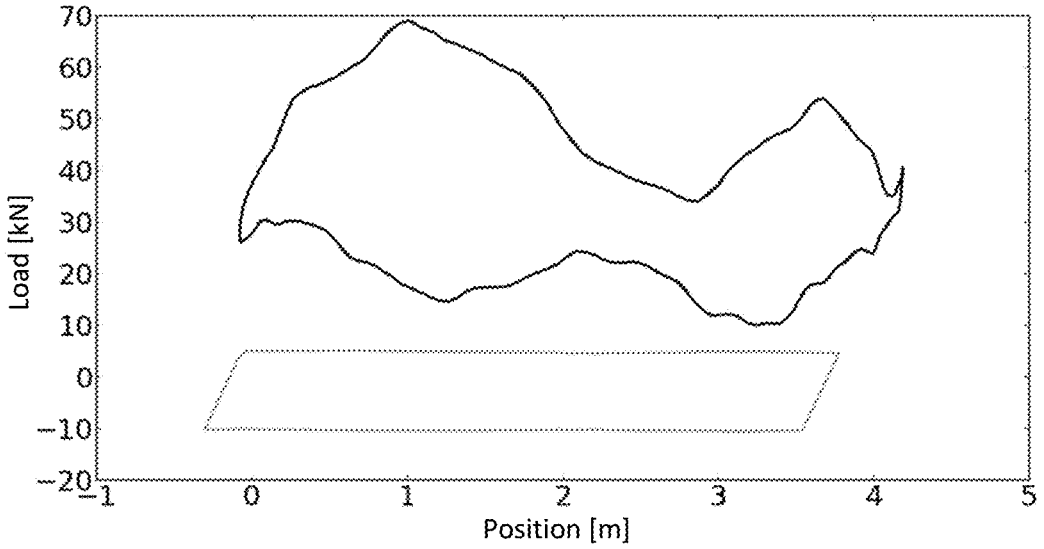
FIG. 9B shows the downhole card associated with a filled pump for that well, in gray the downhole card and in black the surface card obtained after applying the model in predictive mode.
Figure 9C:
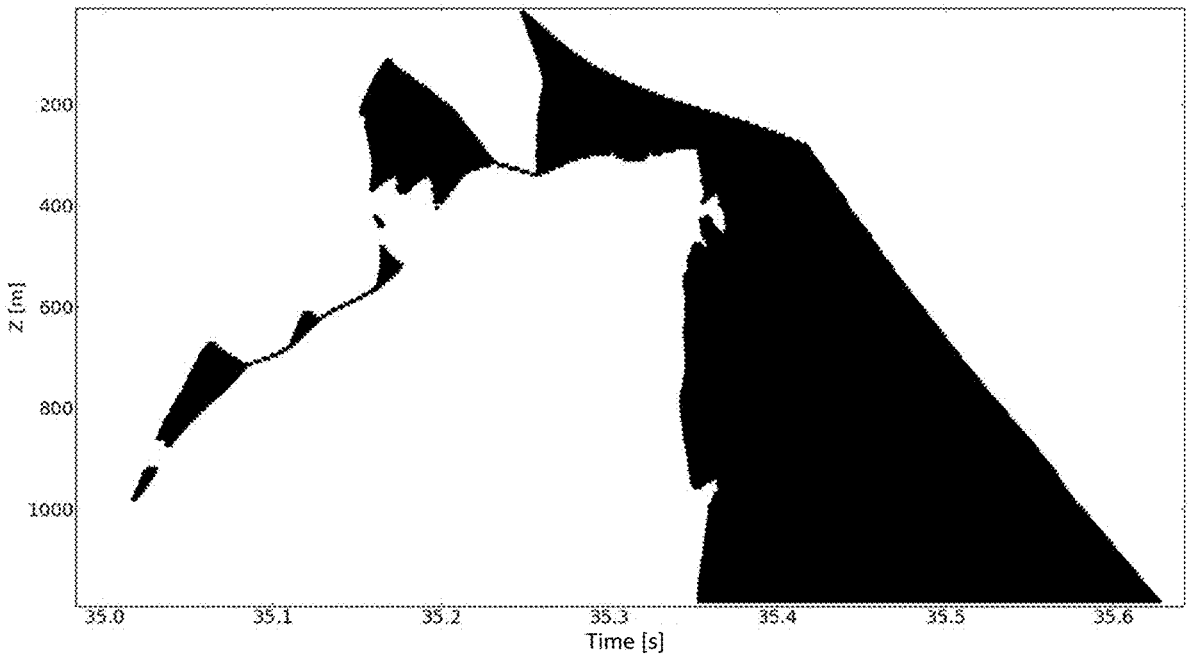
FIG. 9C shows the depths and times at which the sucker rod string element at that depth is fully stopped.
Figure 10B:
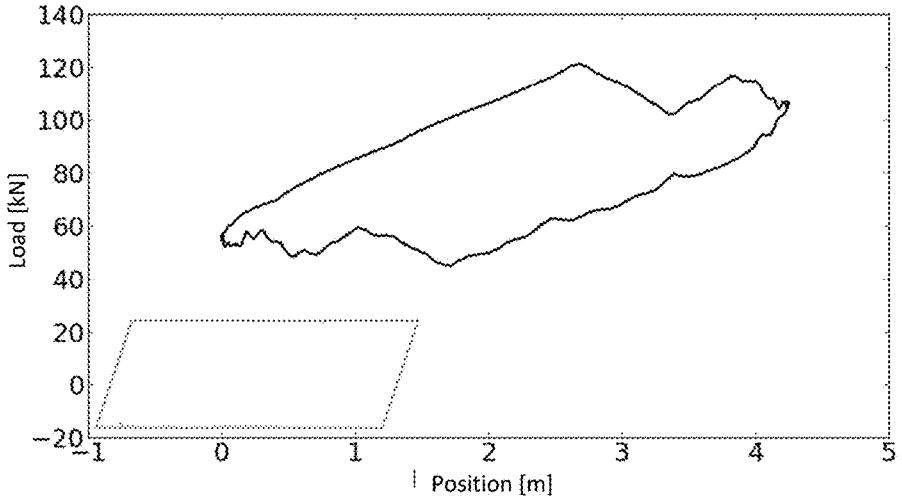
FIG. 10B shows the downhole card associated with a filled pump for that well, in gray the downhole card and in black the surface card obtained after applying the model in predictive mode.
Figure 10C:
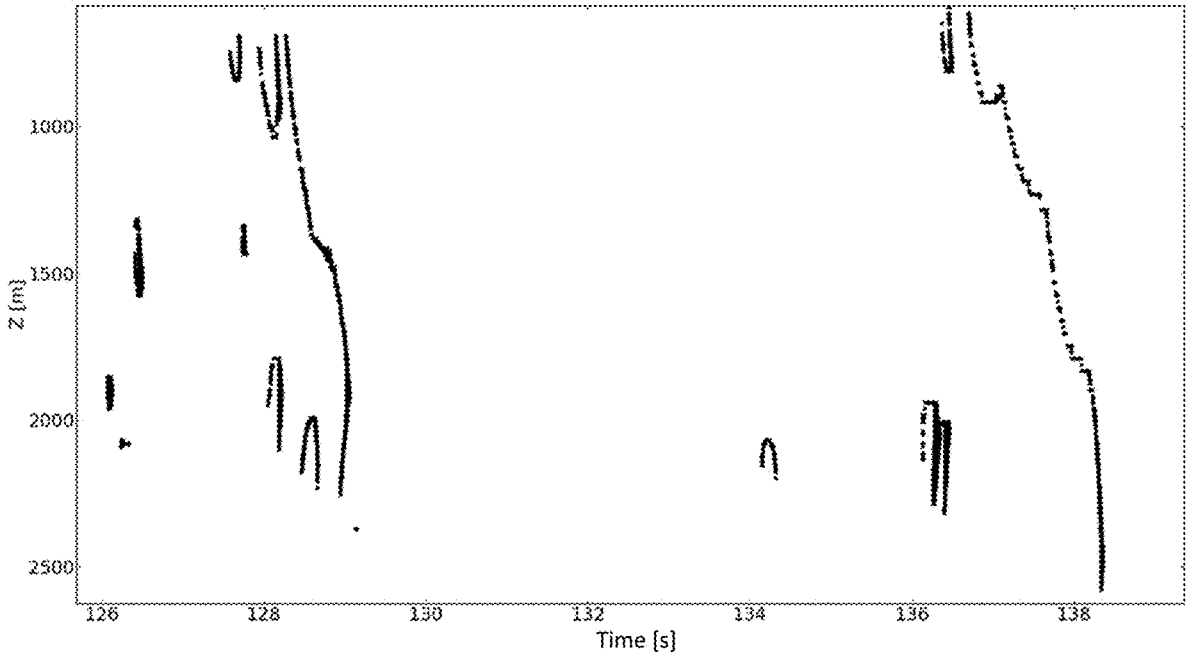
FIG. 10C shows the depths and times at which the sucker rod string element at that depth is fully stopped.

FIG. 9B shows the downhole and surface card obtained when a filled pump is implemented for the J-shaped well. FIG. 10B shows the card obtained for the case of an S-shaped well. In these cases, where the dynamic and static effects have been analyzed, a dynamic coefficient $\mu_d$ of 0.15 was used for the J-shaped well and one of 0.2 was used for the S-shaped well. The values of the static friction coefficient $\mu_e$ were 0.2 and 0.3 respectively. During the pumping cycle, in both wells stucking effects occur, i.e. situations occur where portions of string stop and there is $\vec{f}_i^{\,*c}$ compatible with the system of equations {(20), (21)}. FIG. 9C shows the points at which the J-shaped string is stuck. This occurs for times near the return points, where the whole set slows down. In the lower portion of the string, stucking times of up to 300 ms are found and, for certain depths, stucking events are multiple. In fact, as shown in FIG. 10C for the S-shaped well, there may be numerous points in the areas of greatest lateral force. In this well, the events are higher in quantity but lower in duration.

Figure 11A:
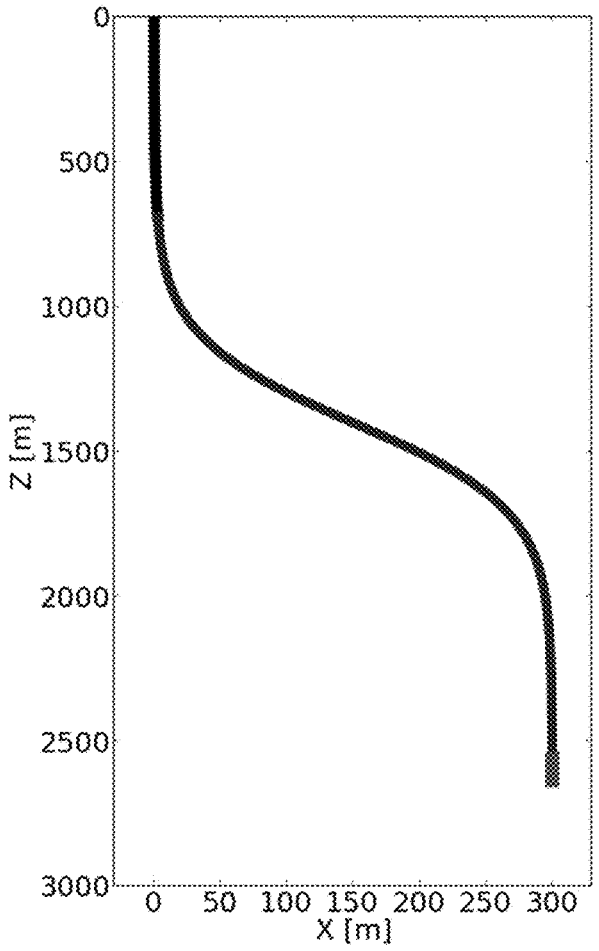
FIG. 11A shows the trajectory of the S-shaped deviated well.
Figure 11B:
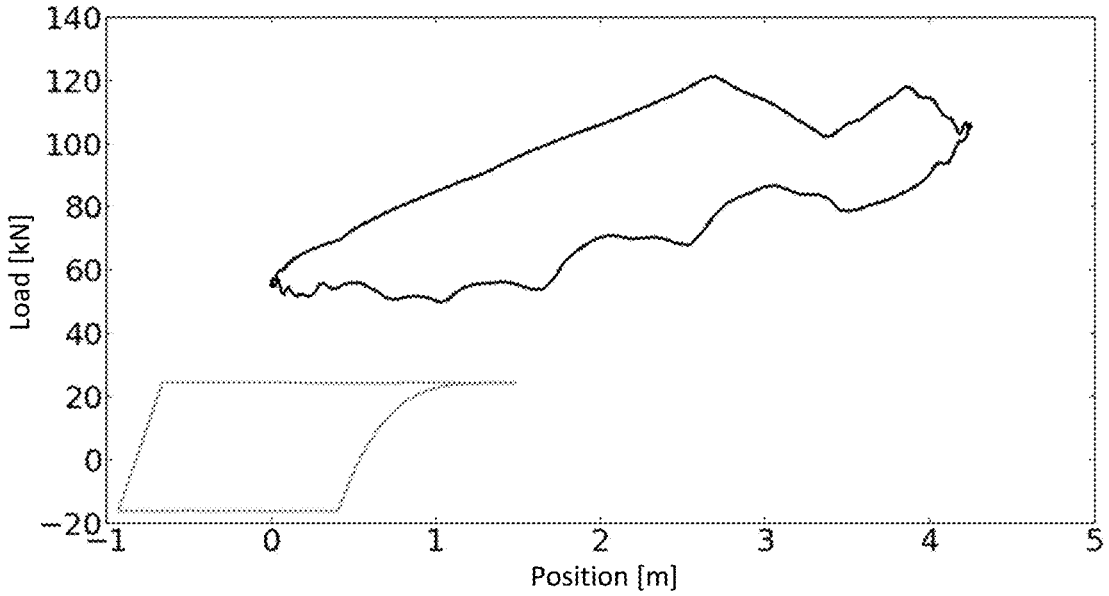
FIG. 11B shows the downhole card associated with a pump that is only partially filled, generating a fluid shock in downward stroke, in grey the downhole card and in black the surface card obtained after applying the model in predictive mode.
Figure 11C:
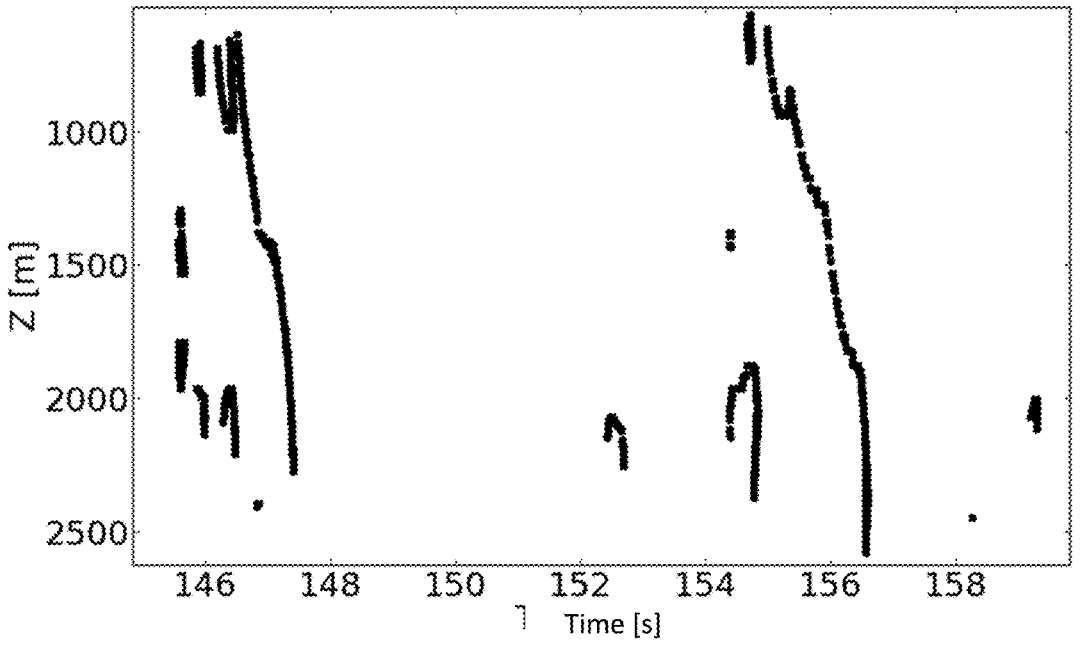
FIG. 11C shows the depths and times at which the sucker rod string element at that depth is completely stopped.
Figure 12A:
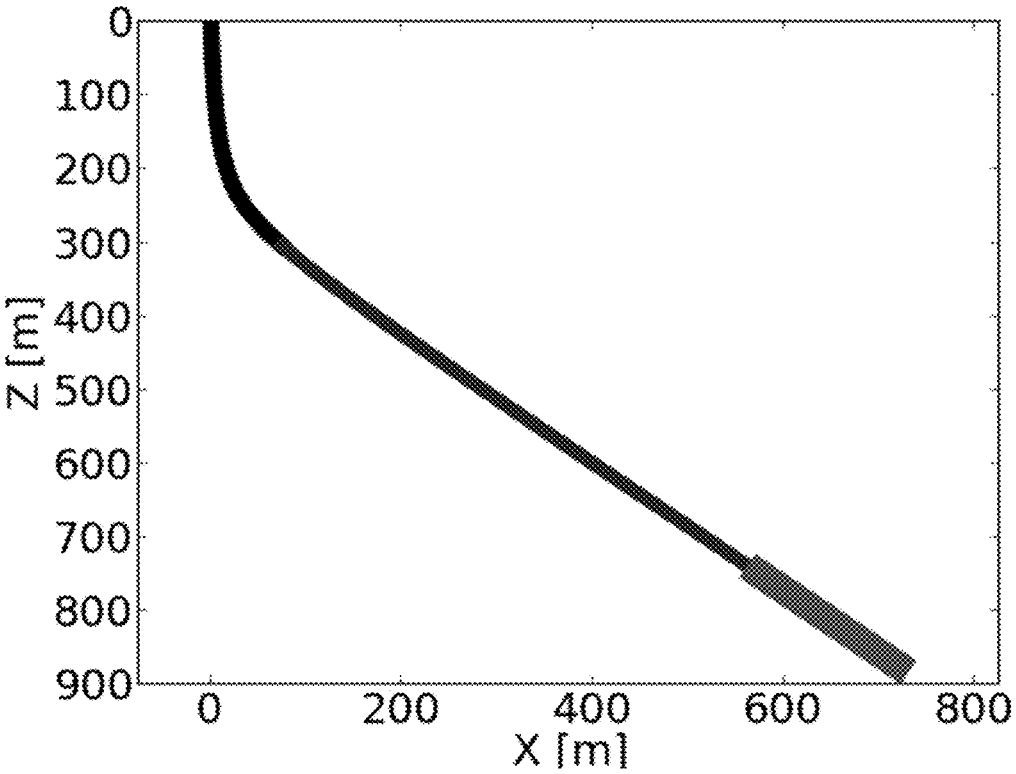
FIG. 12A shows the trajectory of the J-shaped deviated well.
Figure 12B:
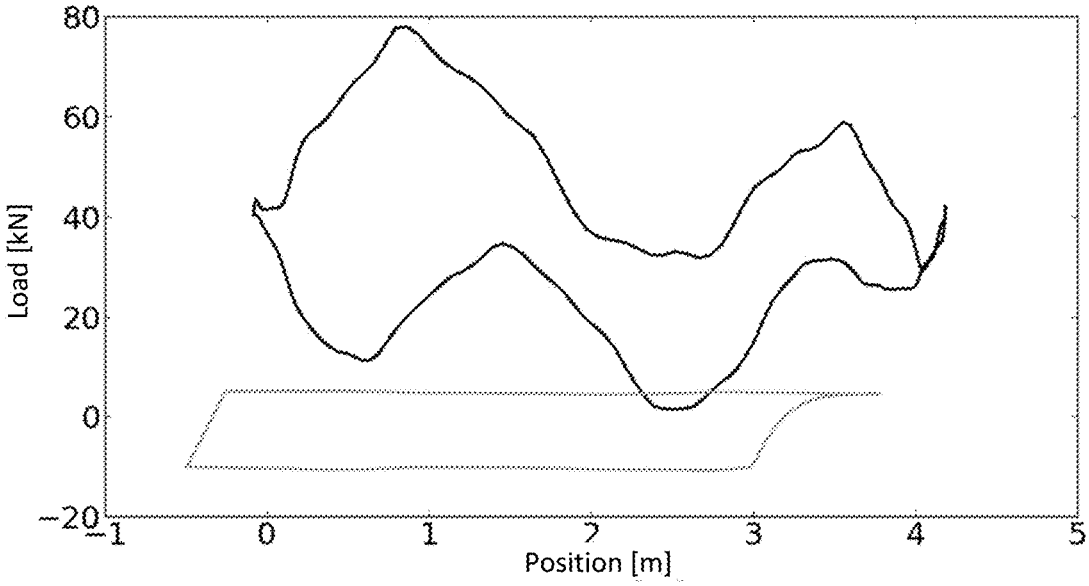
FIG. 12B shows the downhole card associated with a pump that is only partially filled, generating a fluid shock in downward stroke, in grey the downhole card and in black the surface card obtained after applying the model in predictive mode.
Figure 12C:
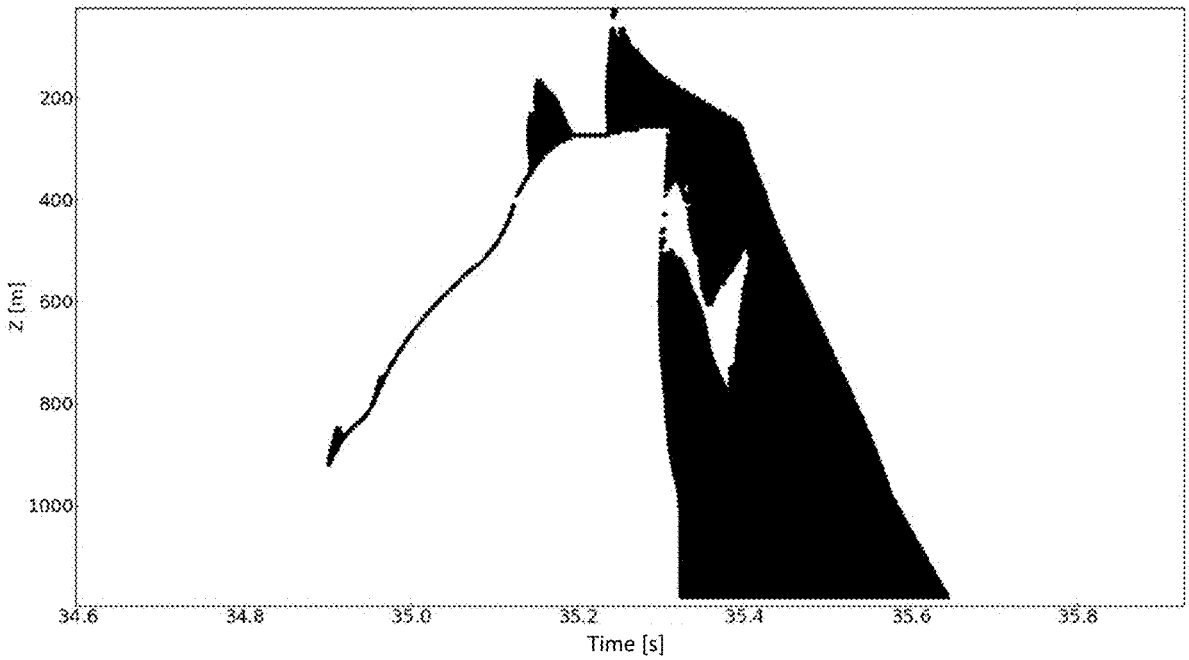
FIG. 12C shows the depths and times at which the sucker rod string element at that depth is completely stopped.
Figure 13A:
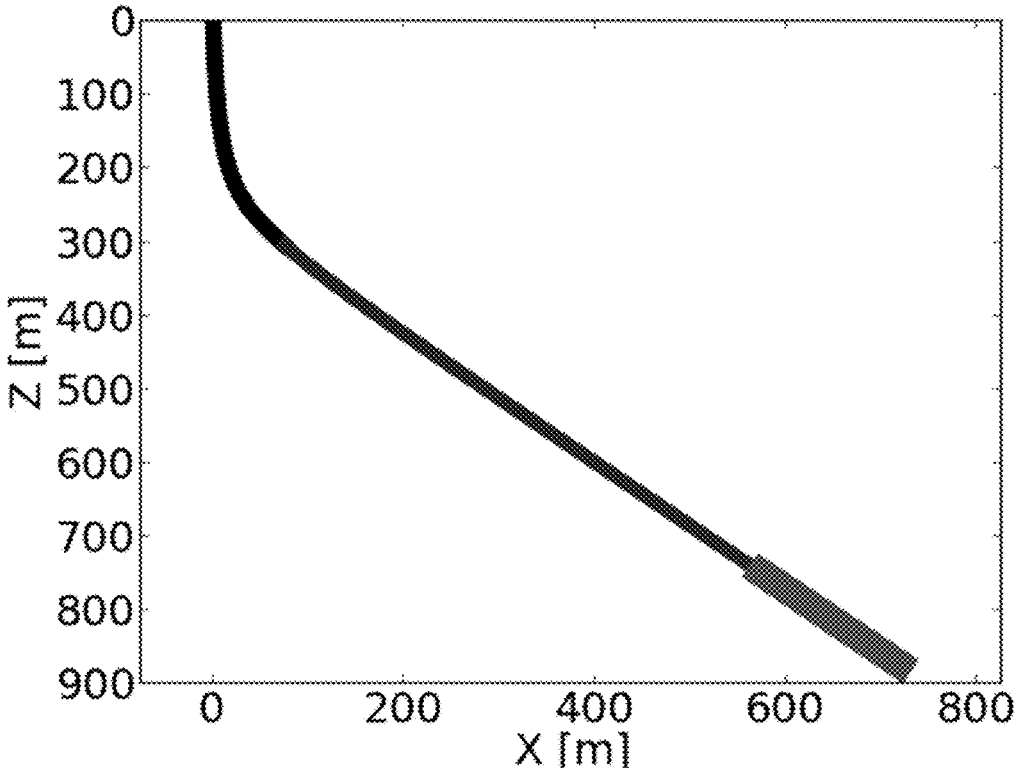
FIG. 13A shows the trajectory of the J-shaped deviated well.
Figure 13B:
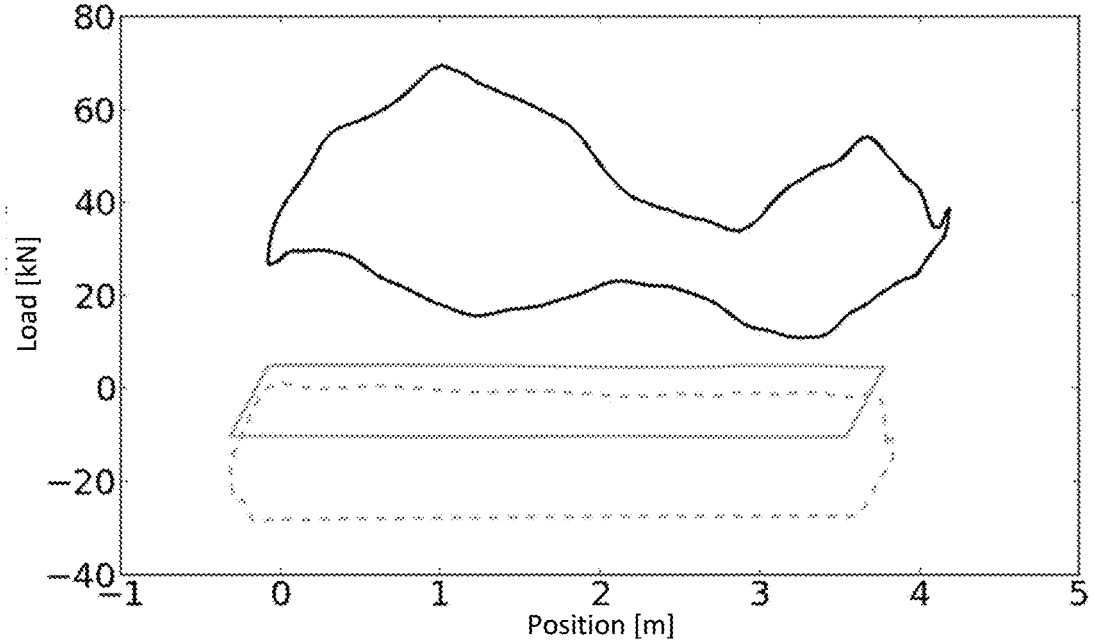
FIG. 13B compares the result obtained when calculating the downhole card using the vertical (dotted grey line) vs. the real (solid grey line) well approach for a given surface card generated without static friction (solid black line) in the case of a filled pump as a downhole boundary condition.
Figure 14A:
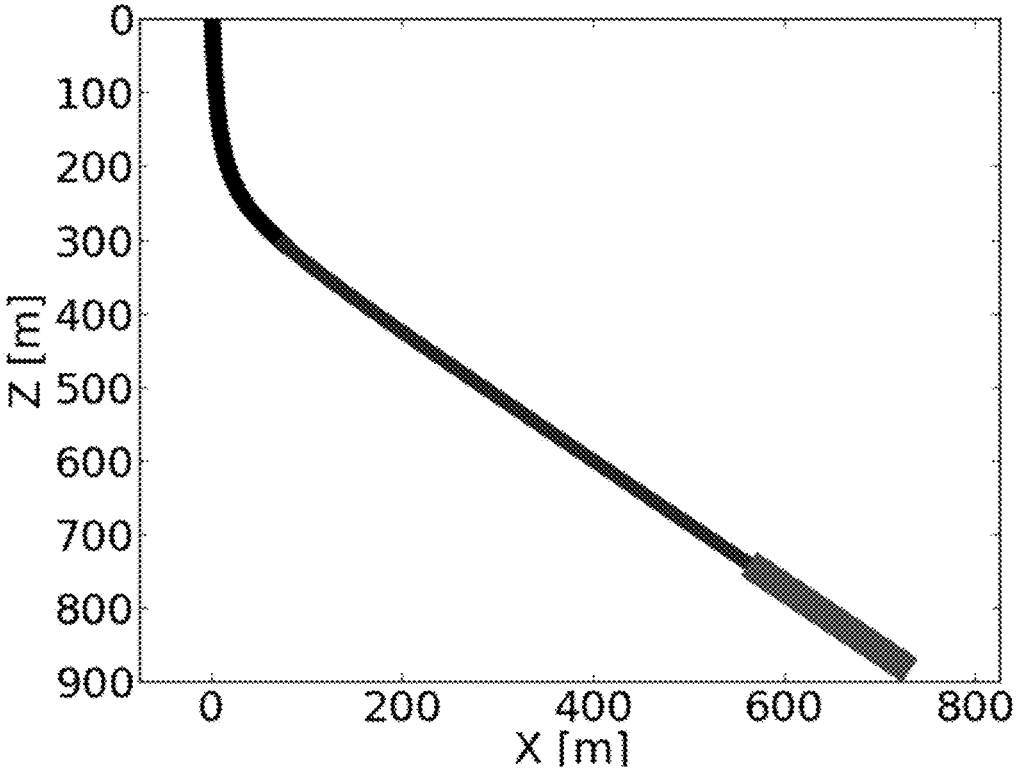
FIG. 14A shows the trajectory of the J-shaped deviated well.
Figure 14B:
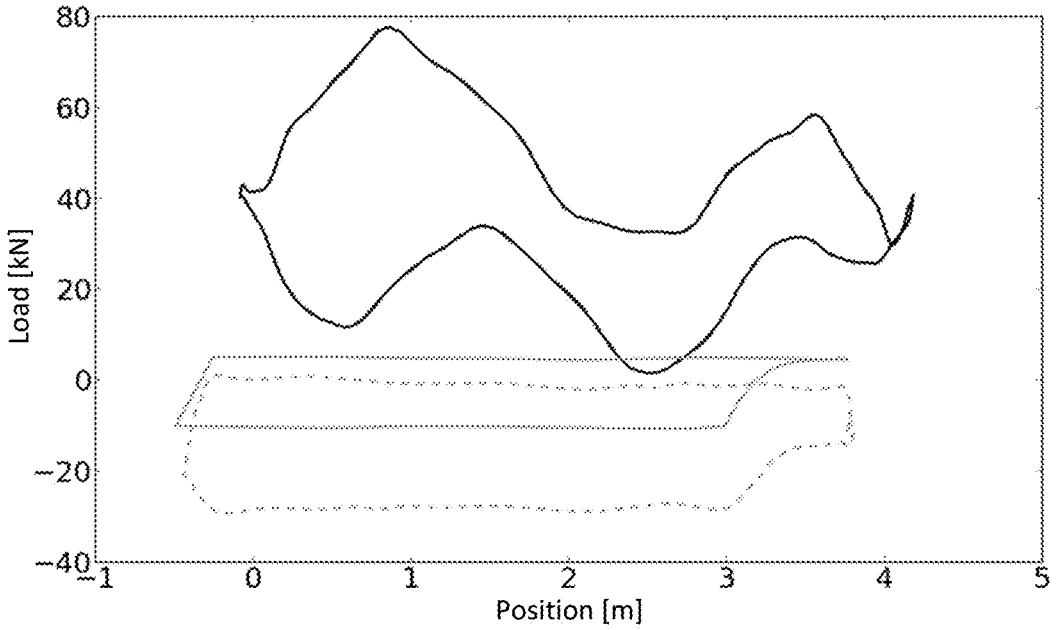
FIG. 14B compares the result obtained when calculating the downhole card using the vertical (dotted grey line) vs. the real (solid grey line) well approach for a given surface card generated without static friction (solid black line) in the case of having a partially filled downhole pump, i.e. developing a fluid shock.
Figure 15A:
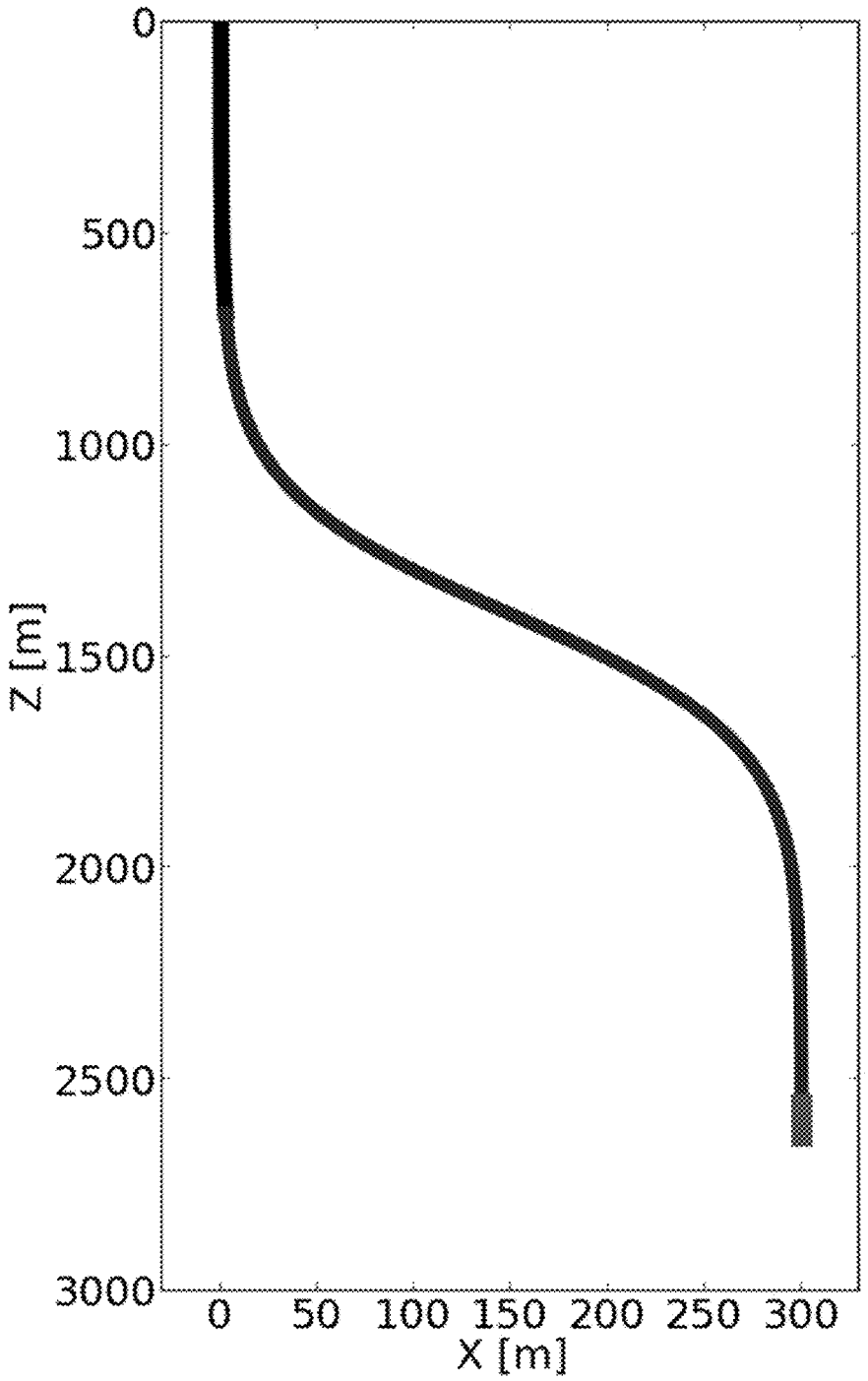
FIG. 15A shows the trajectory of the S-shaped deviated well.
Figure 15B:
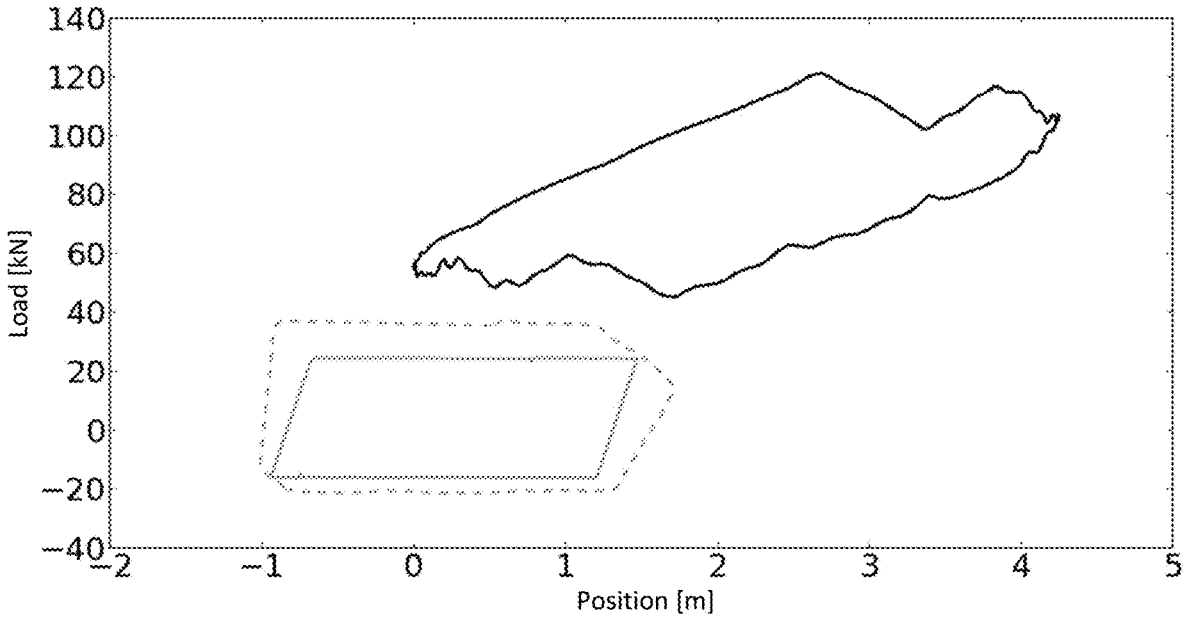
FIG. 15B compares the result obtained when calculating the downhole card using the vertical (dotted grey line) vs. the real (solid grey line) well approach for a given surface card generated without static friction (solid black line) in the case of a filled pump as a downhole boundary condition.
Figure 16A:
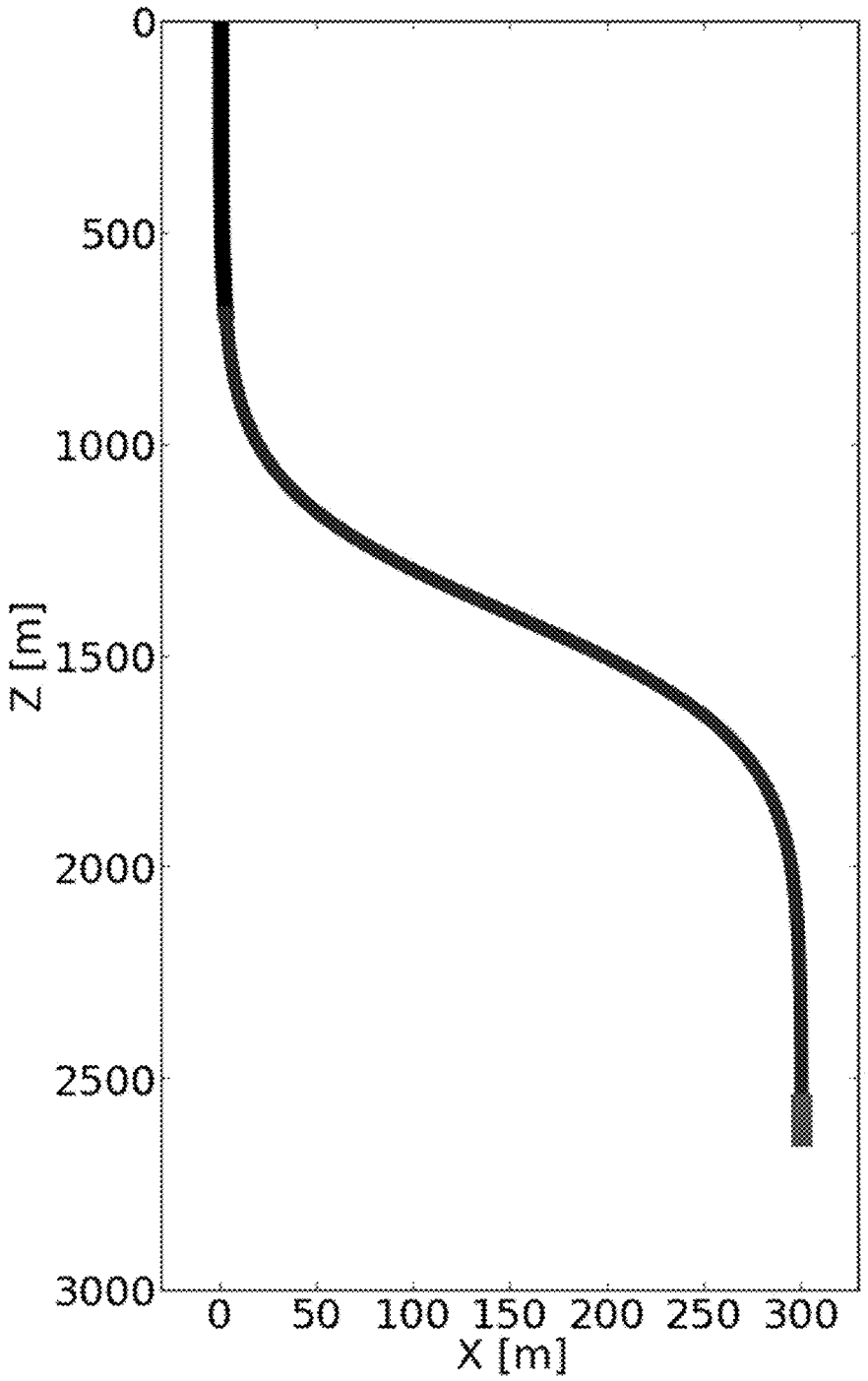
FIG. 16A shows the path of the S-shaped deviated well.
Figure 16B:
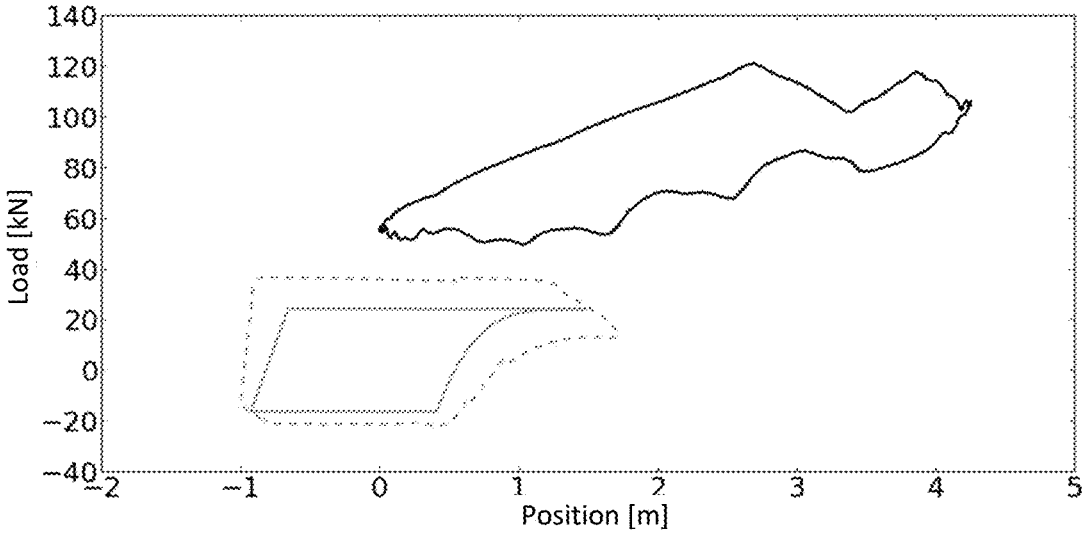
FIG. 16B compares the result obtained when calculating the downhole card using the vertical (dotted grey line) vs. the real (solid grey line) well approach for a given surface card generated without static friction (solid black line) in the case of having a partially filled downhole pump, i.e. developing a fluid shock.
Figure 17:
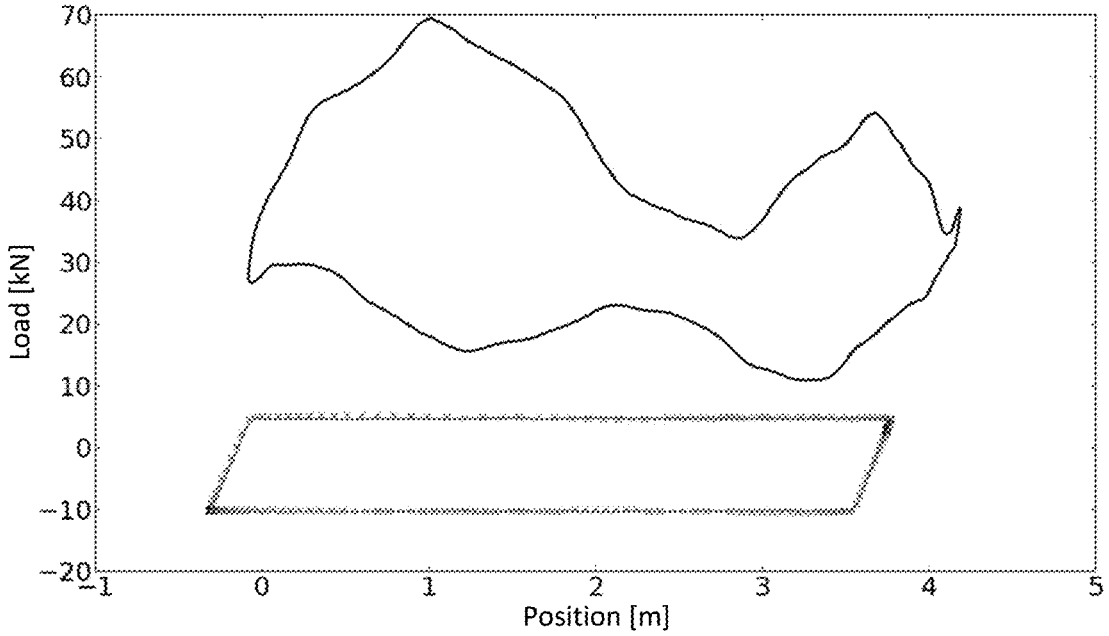
FIG. 17 shows a surface card generated with the predictive model for the J-shaped well (black line) generated with a filled pump boundary condition (gray line) and regularized with a $\alpha$=0.05. Grey crosses show the result of the reverse, diagnostic model, which correctly reproduces the downhole boundary condition.
Figure 18:
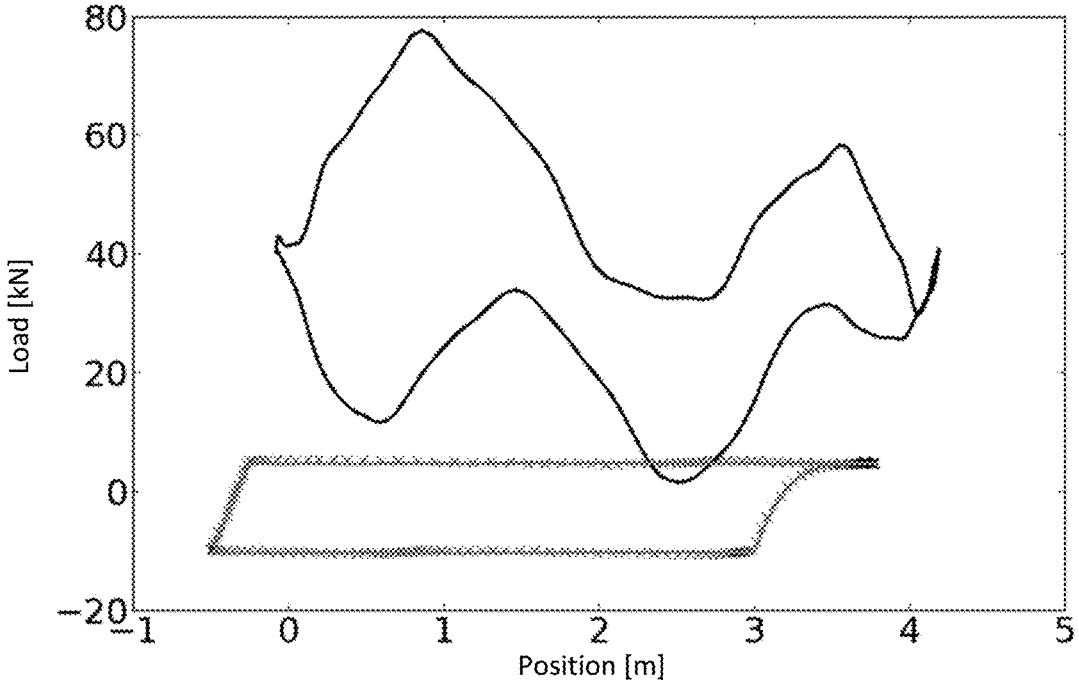
FIG. 18 shows a surface card generated with the predictive model for the J-shaped well (black line) generated with a partially filled pump boundary condition (gray line), developing a fluid shock, and regularized with a $\alpha$=0.05. Grey crosses show the result of the reverse, diagnostic model, which correctly reproduces the downhole boundary condition.

FIGS. 11B and 12B show the downhole and surface cards for the wells in FIGS. 9A and 10A when a "fluid shock" condition is implemented downhole. In this situation, stucking events persist but the structure of the zero speed zones changes.

The model in predictive mode can be used to calculate the surface force and correctly size the pumping device by calculating different scenarios that take into account all the phenomenology downhole. In addition, the pumping string may be subject to greater wear in the areas where the contact against the tubing is greater due to the well deviation. For this purpose, it is relevant to calculate dynamic quantities such as those indicated below, in order to evaluate the degree of mechanical risk.

Figure 22:
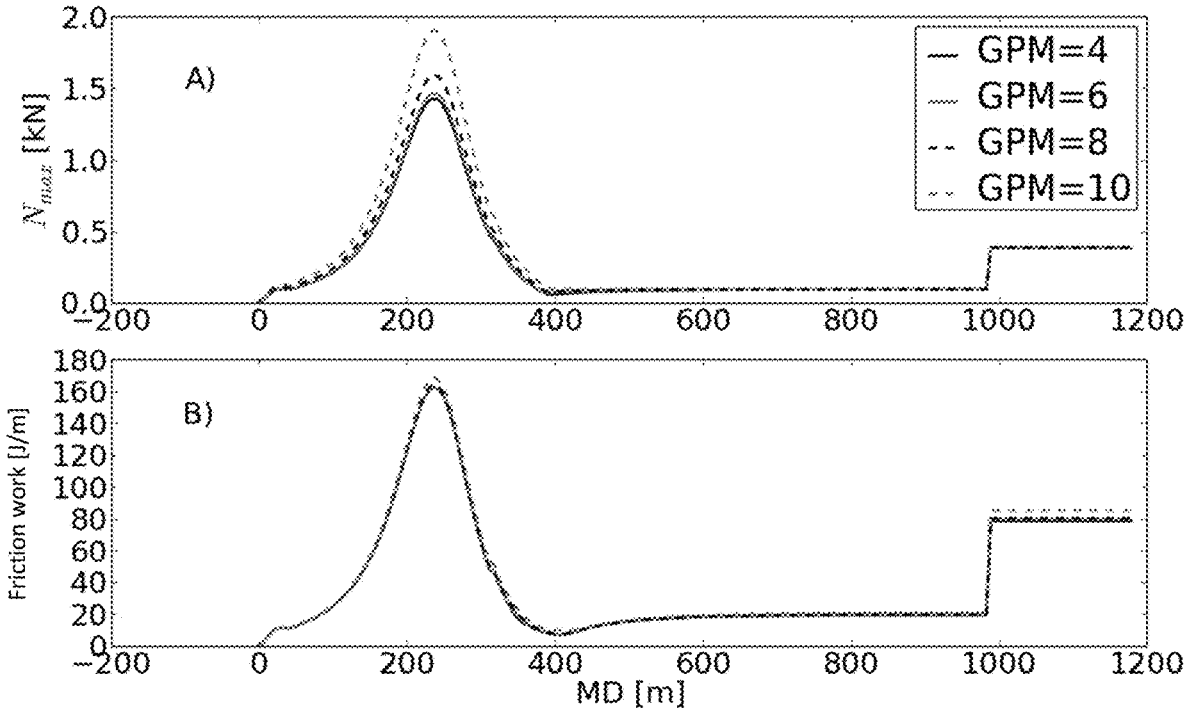
FIG. 22A shows the maximum normal during the pumping cycle and the work of the integrated friction force during a cycle for the pumping conditions of the embodiment of FIGS. 9A, 9B and 9C.
FIG. 22B shows the work of the friction force during the pumping cycle.

FIG. 22A shows the maximum normal during the pumping cycle and the work of the integrated friction force during a cycle for the conditions of the exemplary embodiment of FIGS. 9A, 9B and 9C. FIG. 22B shows the work per cycle for different depths. This merit figure is a direct measure of wear due to dynamic friction. It is interesting to note that, in this particular case, the work per cycle is little sensitive to the pumping speed, as opposed to the value of the maximum normal.

Figure 23:
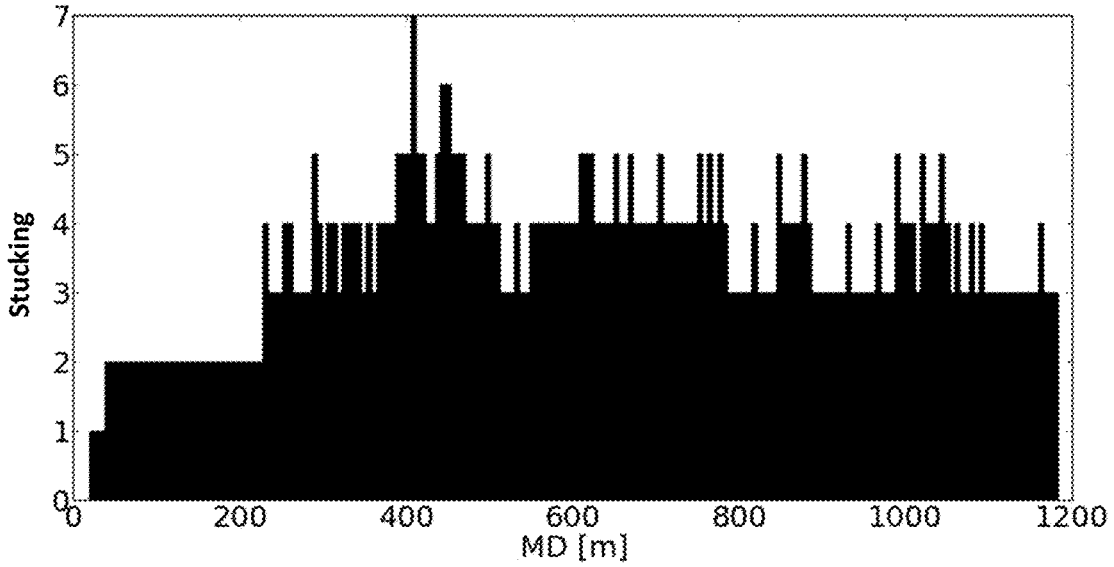
FIG. 23 shows the number of stucking points per cycle for each point of the string according to an embodiment of the method of the present invention, corresponding to FIGS. 9A, 9B and 9C.

FIG. 23 shows the number of stucking points per cycle for each point of the string for the conditions of the exemplary embodiment of FIGS. 9A, 9B and 9C. This other merit figure complements the previous one. It is expected that, as the string and the tubing get stuck, they will change their adhesion mechanism. Thus, these events may contribute to an increase in the wear of these contact areas.

Figure 24:
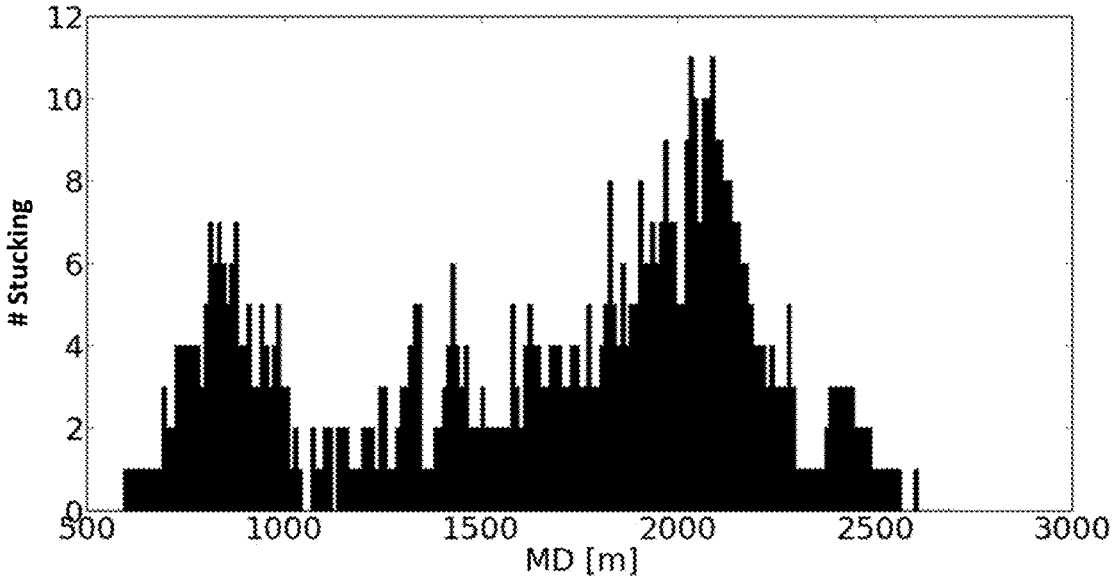
FIG. 24 shows the number of stucking points per cycle for each point of the string according to an embodiment of the method of the present invention, corresponding to FIGS. 10A, 10B and 10C. At the deepest points, more than 10 stucking events can be observed in one cycle.

During a pumping cycle there can be numerous stucking events. FIG. 24 shows the number of stucking events per cycle for each point of the string for the conditions of the exemplary embodiment of FIGS. 10A, 10B and 10C. At the deepest points, more than 10 events can be found in one cycle.

The two merit figures previously described (work per cycle and stucking events per cycle) can be combined to analyze and diagnose wells that have been intervened due to mechanical problems and correlate the areas of greater wear.

The model for deviated well in predictive mode can be used to accurately calculate the error of the model for the vertical well that is usually embedded in commercially available automatic well control systems. For the examples previously analyzed, S-shaped and J-shaped, with a filled pump and fluid shock, in FIGS. 13, 14, 15 and 16, the downhole card is calculated from the surface card using the vertical model (Gibbs' equation for vertical well).

These examples show that both the shape and the load range of the downhole card are totally distorted and could not be used for a proper diagnosis, making evident the need to use a deviated well model in the downhole diagnosis, such as the one used in the method of the present invention.

Diagnostic Mode

The method in diagnostic mode enables solving, in another order, the same system of equations of the mathematical model. The objective is to use the information measured at the surface to determine in a self-consistent way the dynamics of the string downhole. Given that the problem mechanically couples first neighbor elements, initially, knowledge of the temporal evolution of the (i−1)-th and i-th elements, enables the implicit calculation of the position of the (i+1)-th element in such a way that the balance of the amount of movement for the i-th particle is satisfied. Next, it will be shown under which conditions this inversion process is feasible and the type of difficulties originated by the Coulomb friction force.

Firstly, in the prior art it is assumed that the periodic actuation of the polished rod position over time always comes with a periodic force at the surface. When both static and dynamic friction forces are present, this is no longer an obvious hypothesis, since the force at the surface may lose its periodicity, even when the position remains periodic, as demonstrated by the presence of chaos in systems with a single periodically forced element constantly under Coulomb friction [B. Feeny and F. C. Moon. *Chaos in a forced dry-friction oscillator: Experiments and numerical modelling*. Journal of Sound and Vibration 170(3):303_323; G. Licsko and G. Csernak. *On the chaotic behavior of a simple dry-friction oscillator*. Mathematics and Computers in Simulation 95 pp. 55-62 (2014)].

Figure 19:
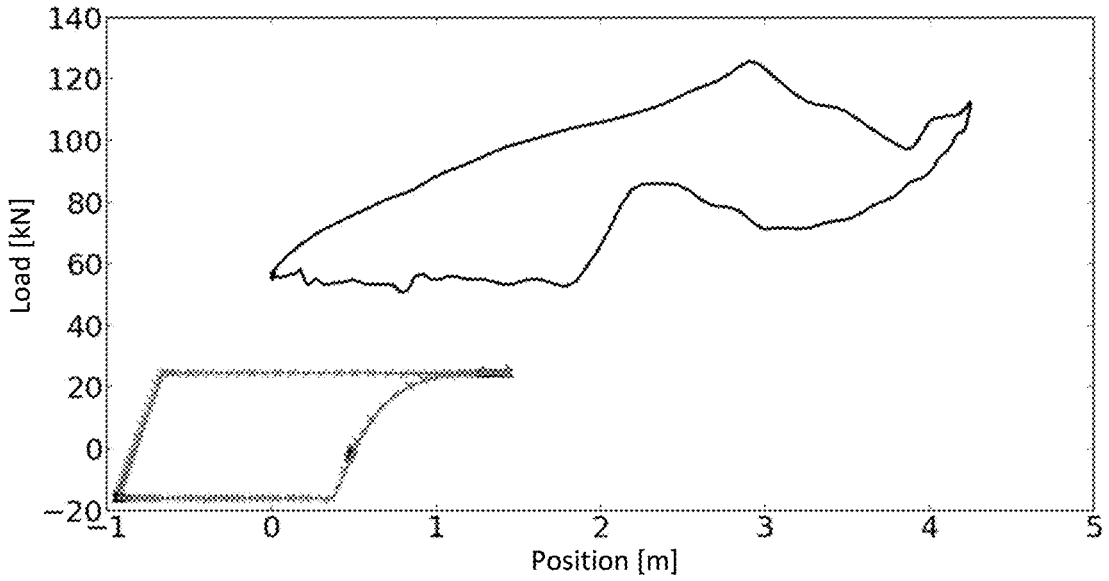
FIG. 19 shows a surface card generated with the predictive model for the S-shaped well (black line) generated with a partially filled pump boundary condition (gray line), developing a fluid shock, and regularized with a $\alpha$=0.05. Grey crosses show the result of the reverse, diagnostic model, which correctly reproduces the downhole boundary condition.
Figure 20:
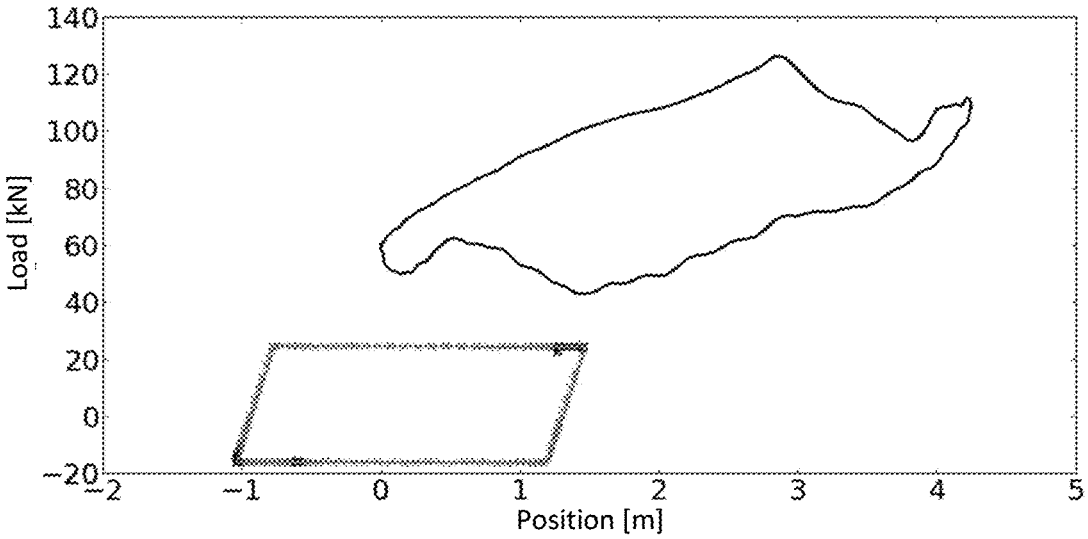
FIG. 20 shows a surface car generated with the predictive model for the S-shaped well (black line) generated with a filled pump boundary condition (gray line) and regularized with a $\alpha$=0.05. Grey crosses show the result of the reverse, diagnostic model, which correctly reproduces the bottom downhole condition.
Figure 25:
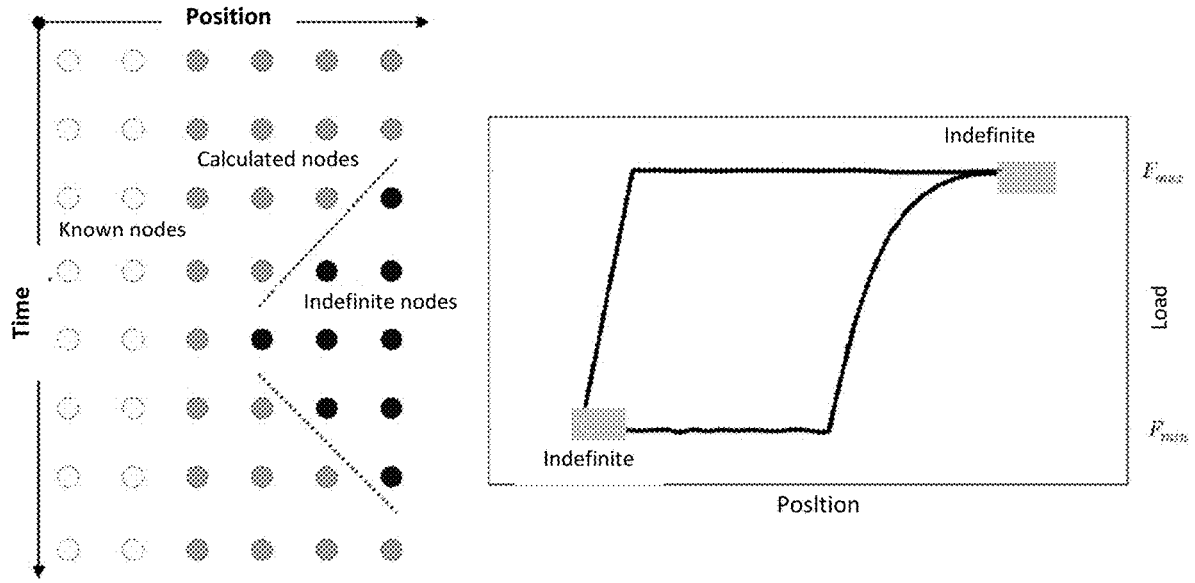
FIG. 25 shows a reversion scheme based on the Everitt-Jennings method for the diagnosis problem of the present model.

Even assuming that both the surface force and the position of the first element are periodic, it is possible to find difficulties in the inversion process. To demonstrate this, a scheme similar to Everitt-Jennings' is considered, where the derivatives are replaced by their discrete second-order approximations, applied to the case in which static friction is possible, as shown in FIG. 25. When the particles are in motion, the system of equations that are verified is {(15), (16), (17)}, and therefore it is possible to uniquely solve the position of the (i+1)-th particle in time t by solving the implicit problem, which has a well-defined solution. However, when a particle stops with a condition compatible with stucking, there will be more than one solution compatible with balance. This makes the position of the (i+1)-th element indeterminate (i.e., more than one solution exists), and the lack of information spreads through the grid of the numerical solution at the grid rate, as shown in FIG. 19, preventing the inversion of the problem for all the nodes remaining within the cone generated from this stucking condition. Therefore, in this section the case where only the dynamic friction is taken into account must be distinguished. In the following section, the inversion case will be analyzed using another scheme, called "hybrid method".

When only dynamic friction is taken into account, the problem consists in implicitly solving the zero of the $R(s_{i+1}(t))$ function, given by:

$$R(s_{i+1}(t)) = -m_i \frac{d^2 s_i}{dt^2} + \vec{f}^{+}_{r,i} \cdot \hat{\tau}_i + \vec{f}^{-}_{r,i} \cdot \hat{\tau}_i + m_i \vec{g} \cdot \hat{\tau}_i + \vec{f}^{c}_i \cdot \hat{\tau}_i + \vec{f}^{v}_i \cdot \hat{\tau}_i + \vec{f}^{p}_i \cdot \hat{\tau}_i \tag{32}$$

Figure 6:
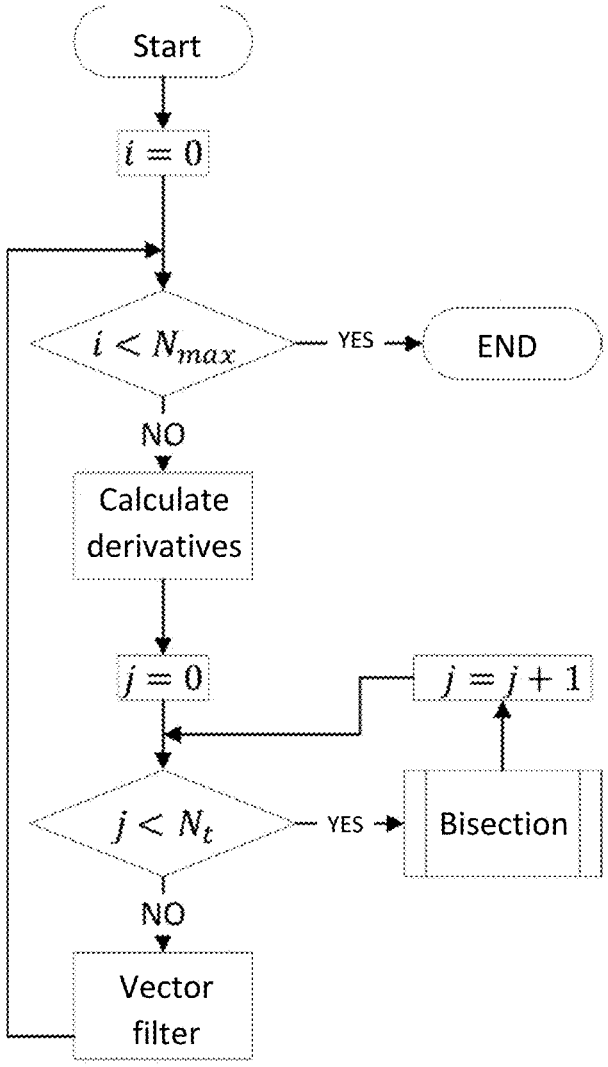
FIG. 6 shows a representative flow chart of an implicit Everitt-Jennings algorithm used to solve the problem in diagnostic mode.
Figure 7:
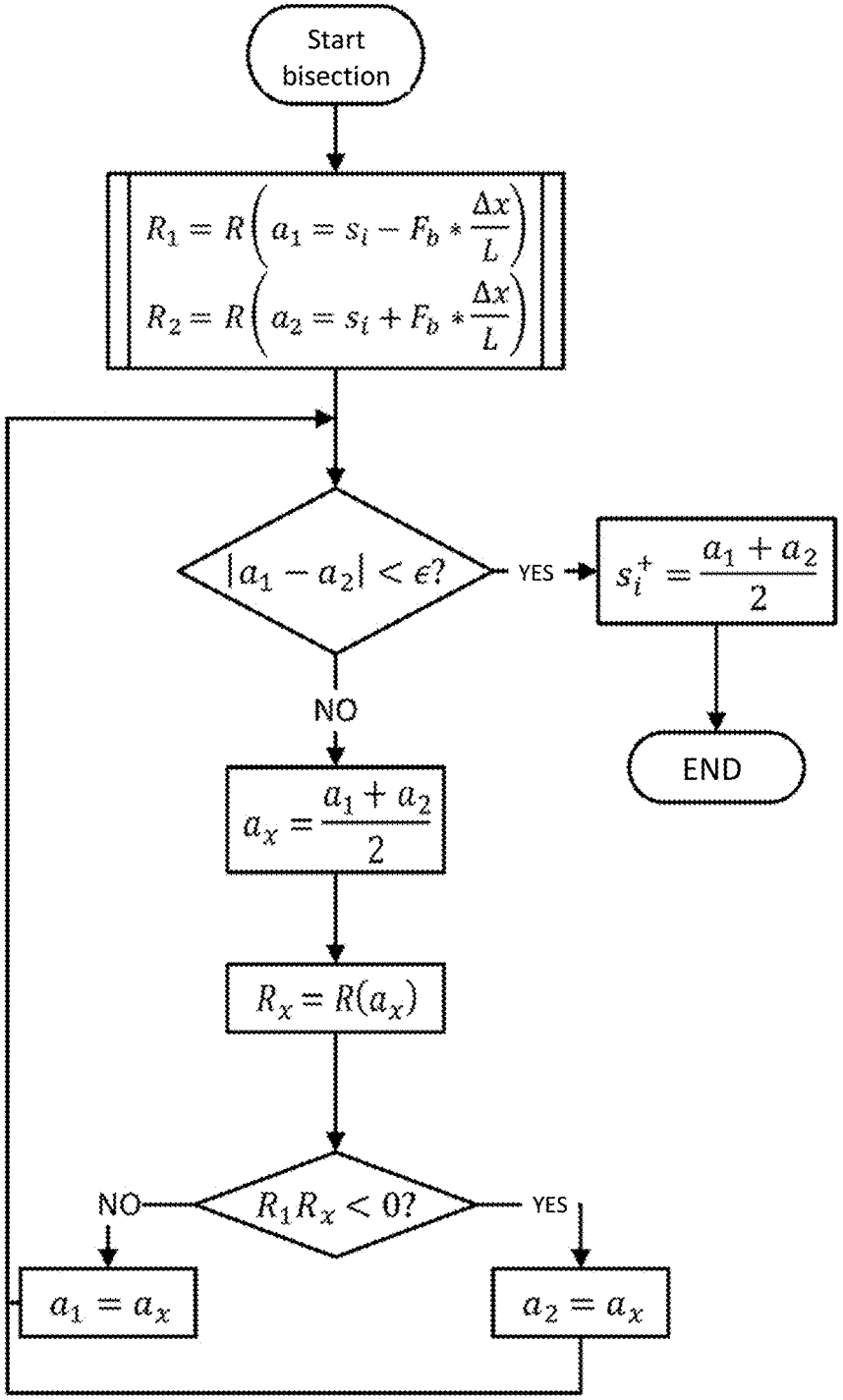
FIG. 7 shows a flow chart of the bisection stage in the diagnostic mode of FIG. 6.

FIGS. 6 and 7 show how to execute a very robust iterative procedure that enables finding the zero of R. To improve numerical performance, fixed-dimension arrangements are taken with only one movement period and time derivatives are calculated at the discrete times $t_l$ on the basis of the representation $$s_i(t_l) = \sum_{k=0}^{k<D} \widehat{s_{i,k}} e^{j\omega_k t_l} \tag{33}$$

i.e.

$$\dot{s}_i(t_l) = \sum_{k=0}^{k<D} i\omega_k \widehat{s_{i,k}} e^{j\omega_k t_l} \tag{34}$$

$$\ddot{s}_i(t_l) = \sum_{k=0}^{k<D} -\omega_k^2 \widehat{s_{i,k}} e^{j\omega_k t_l} \tag{35}$$

where $\widehat{s_{i,k}}$ are the Fourier coefficients of the discrete representation of $s_i$, and j is the imaginary unit, so that $j^2=-1$.

Figure 26:
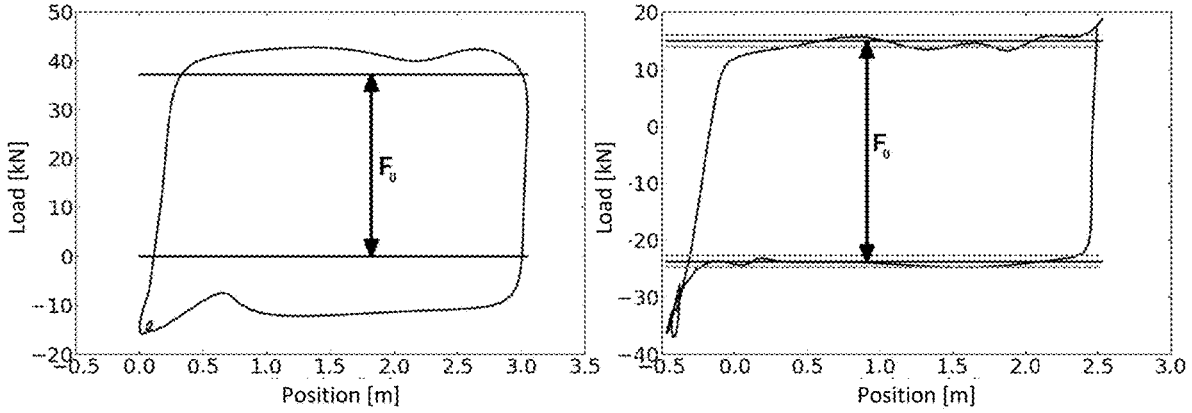
FIG. 26 shows an example of determining the range of downhole loads (designated as $f_0$) required for the calculation of submergence from the vertical well model and the deviated well model.

The resolution of the previous problem enables obtaining $s_{i+1}(t)$ and therefore moving forward to arbitrary depths, in particular to the downhole pump. When the effect of static friction force does not have a significant impact at the surface card, it is possible to use this model to calculate the bottom variables and inferred magnitudes. FIG. 26 shows the difference obtained downhole card using the vertical well model and the deviated well model in a real well. Each of these models enables calculating a range of downhole loads $f_0$. Said range of values is obtained from the downhole card and is called the "obtained force range of the downhole card". This magnitude is useful to determine the pressure at the pump inlet $p_i$ using the relationship:

$$p_I = P_D - \frac{f_0}{A_B} \tag{36}$$

where $p_D$ is the pressure in the discharge and $A_B$ is the area of the pump piston. The pressure at the pump inlet defines whether the well is well exploited or not. For example, when the pump submergence associated with such inlet pressure is lower than 200 m, the well will typically be considered well exploited. Since the discharge pressure can be approximated by knowing the properties of the fluid column in the tubing, estimating $f_0$ is equivalent to estimating the pressure at the inlet through the downhole dynamometer. When using the vertical well card, such as that obtained using the methods of the prior art, it is impossible to make the direct measurement of submergence, obtained for example by echometric, compatible with the inferred value. The left panel of FIG. 26 shows the value of $f_0$ necessary to make the dynamometric measurement compatible with the echometry. When using the model for deviated wells of the present invention, such value of $f_0$ coincides with the direct measurement within the error.

For this comparison, the $f_0$ load range estimate obtained by means of the model of the present invention is validated with a direct measurement. In the analyzed cases of practical interest, the results of the model are coincident to the measurements exemplified above, as shown in FIG. 26.

The regularization (25) of the sign function enables avoiding the generation of numerical error when the string changes its motion direction and the friction forces on the elements suddenly fluctuate in their direction. Even in synthetic cases such as those developed below, it is possible that noise persists and spreads by sequentially resolving the position of the particles.

FIGS. 17, 18, 19 and 20 show examples in which a surface card is generated with the predictive method and then the downhole card is recalculated with the method in diagnostic mode. When the sign factor a is 0.05, it is possible to build the surface card with the predictive method and to obtain the downhole card again with the method in diagnostic mode without accumulating a significant numerical error. On the contrary, when this parameter decreases, for example, to a value lower than 0.01, the model used in the predictive mode becomes stable while the one in the diagnostic mode accumulates noise.

Figure 27:
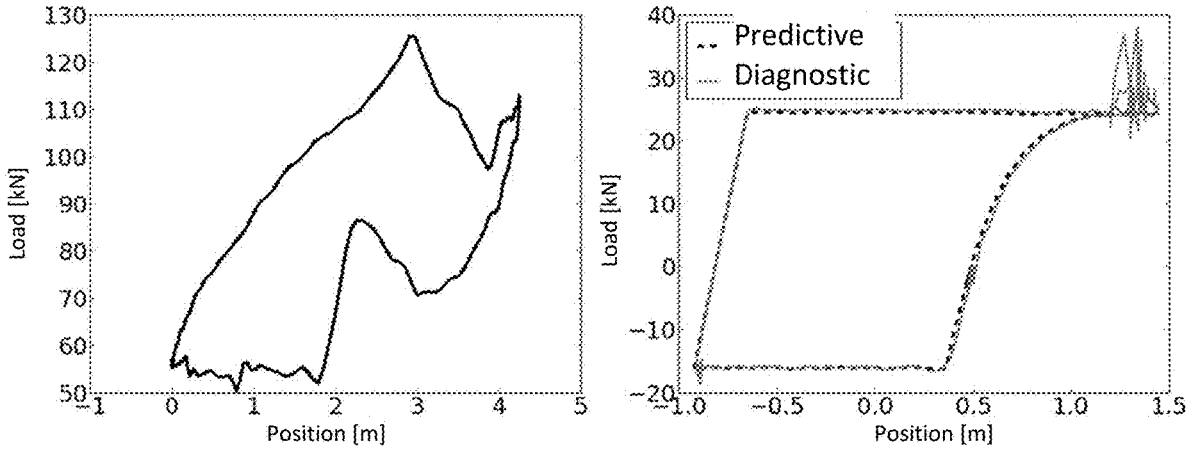
FIG. 27 shows the case of a downhole card generated with the predictive method with a sign factor of 0.01 and then recalculated with the diagnostic method with a sign factor of 0.01. The whole process starts to accumulate numerical noise.

FIG. 27 shows for one of the previous examples the type of numerical noise that is accumulated when the sign factor $\alpha$ is decreased to 0.01.

Although almost every time the inversion process can be carried out without difficulty, it is desirable to have a technique that enables the complete elimination of the noise of the inversion process while keeping the error under control in the solution of the complete problem. A simple temporary filter applied at a given depth would not enable estimating if the dynamic effects actually existing are being eliminated.

Therefore, it is desirable to have a method that enables simultaneously controlling the noise and to invert the system of equations to calculate the downhole card. Such a method for use in diagnostic mode will be named "hybrid method" and will be described in the following section.

Diagnostic Mode: Hybrid Method

This method uses the inherent stability of the predictive problem, where boundary conditions allow a well-conditioned problem to evolve, to solve the diagnostic problem. The method involves using two phantom nodes $s_{-1}(t)$ y $s_N(t)$, which are specified for an auxiliary predictive problem. The $s_{-1}(t)$ node is determined by the position of the polished rod based on time, which is a data in the diagnostic problem. In contrast, the $s_N(t)$ node is expressed by a Fourier development in series, which coefficients are adjusted to predict the value of the force measured at the surface. For functionality, this series is truncated into a maximum number of harmonics of the fundamental period. Typically, with 50 harmonics a suitable description is achieved in cases of practical interest. In general, the function $s_N(t)$ will be parameterized, and the parameters defining it will be adjusted so as to reproduce the two surface measurements, polished-rod position and force.

The problem is a diagnostic one, since the solution found corresponds to the downhole series that generates the surface data being measured, but at each step of the search a predictive-type problem is explicitly solved. For this reason, the method is called "hybrid": it is a method in diagnostic mode that uses the predictive mode as a core. Specifically, in a preferred embodiment of the present invention, the $s_N(t)$ series is represented by a truncated Fourier series development:

$$s_N(t) = \sum_{k=-M}^{k<M} \widehat{s_{N,k}} e^{ju\omega_k t} \tag{37}$$

where M is the number of modes included in the sum. The boundary condition is parametrized by the coefficients $\widehat{s_{N,k}}$ which are used as variables to minimize the target function $$O = \sum_l \left(F_l - F_l^{pred}[\widehat{s_{N,k}}]\right)^2 + \alpha \sum_l \left(f_l^{(d)} - f_{l+1}^{(d)}\right)^2 \tag{38}$$

Where $F_1$ is the force data measured at the polished rod, and $F_l^{pred}$ [ $\widehat{s_{N,k}}$ ] is the force on the polished rod calculated from the predictive model when downhole the phantom node coefficients are $\widehat{s_{N,k}}$. Downhole strength $f_l^{(d)}$ at the time $t_l$ is used to control the noise, taking a penalty against its next value in $t_{l+1}$ and weighing the full penalty term with a factor $\alpha$ that enables weighing the minimization of downhole noise vs. the regularization to the card at the surface. The sum over the discrete times $t_l$ is performed over a period of motion. Since the basic problem corresponds to the predictive mode, several cycles of piston movement must be calculated in order to eliminate the dependence on the initial conditions and eventually reach the stationary state. In this way, it is possible to solve the diagnostic problem using the predictive problem as the core. To search for the minimum of the function O, any algorithm that can find an overall minimum can be used. For example, a combination of methods based on descending in the direction opposite to the gradient can be used. The search starts from a point very close to the solution, since the method in diagnostic mode described in the previous section yields the correct solution at all points where the Coulomb force has already made the transition to a constant value.

Figure 8:
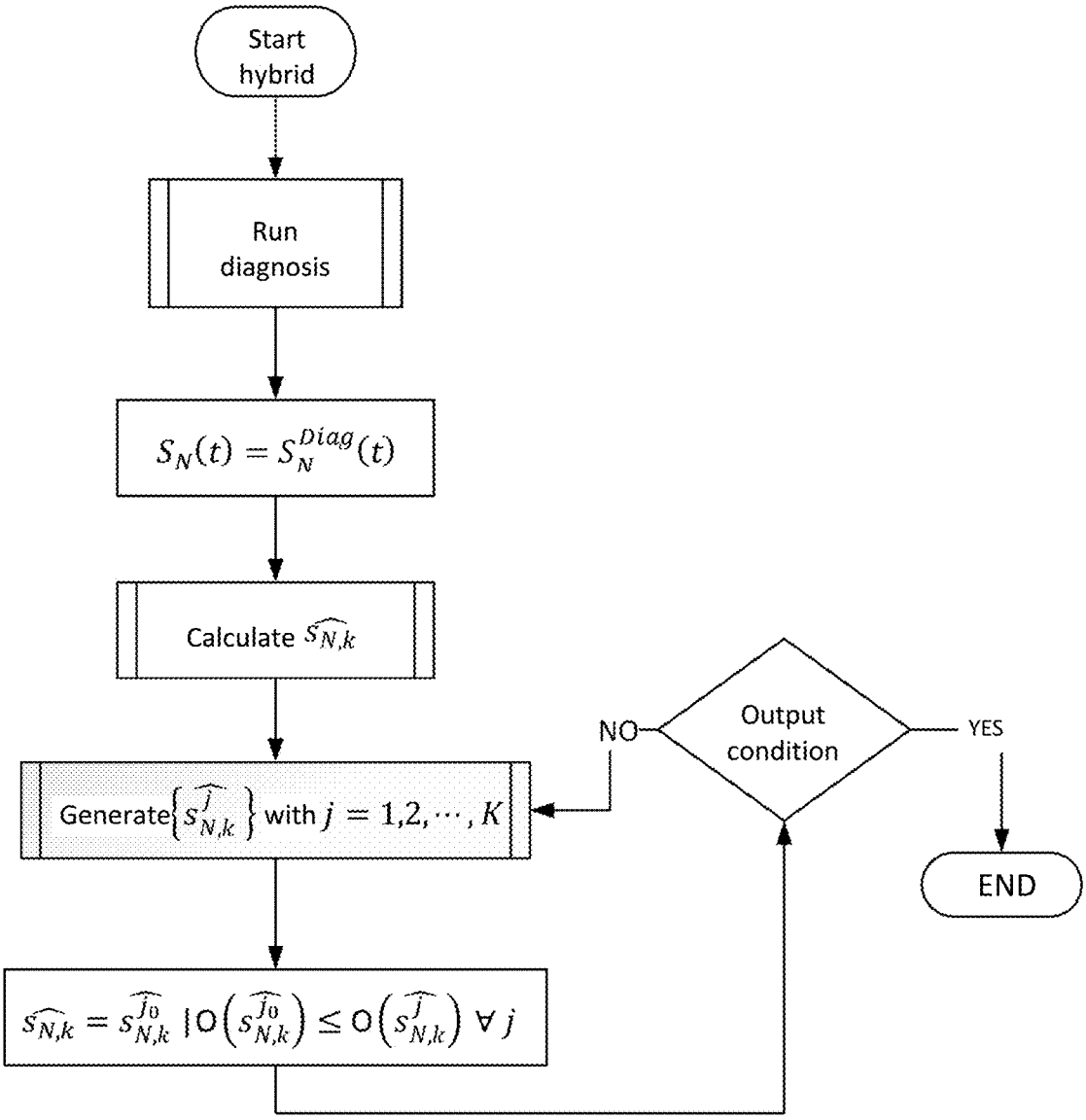
FIG. 8 shows a flow chart representative of the hybrid prediction-diagnosis method of the present invention.

FIG. 8 shows an algorithm for executing the hybrid method. This method is inherently stable. In each step of the algorithm, K { $\widehat{s_{N,k}}$ } sets are generated with j=1.2, . . . K, by an adapted generation method, such as by taking j=1.2, . . . K sets obtained by evaluating the gradient of the target function and giving j=1.2, . . . K steps in the direction of descent of that function. This in turn can be combined with other techniques not based on the gradient calculation, for example techniques based on the generation of random numbers such as Monte Carlo methods, for example simulated annealing methods or other methods for minimizing functions, until reaching the defined outlet condition. On the other hand, it is possible to filter the data in a controlled way through the a factor. In this way, the discrepancy with the surface measurement can be minimized, while the data is filtered in a controlled manner. Since the core is based on the predictive model, its stability and advantages are inherited by this method. For example, it is possible to incorporate static friction, since the mathematical model of the method in predictive mode is always well conditioned. However, in the latter case, although the method enables diagnosing with all the incorporated phenomenology, the inverse problem may experience similar difficulties, since the lack of unicity in the solution will be manifested with insensitivity of the target function to downhole changes.

Figure 21A:
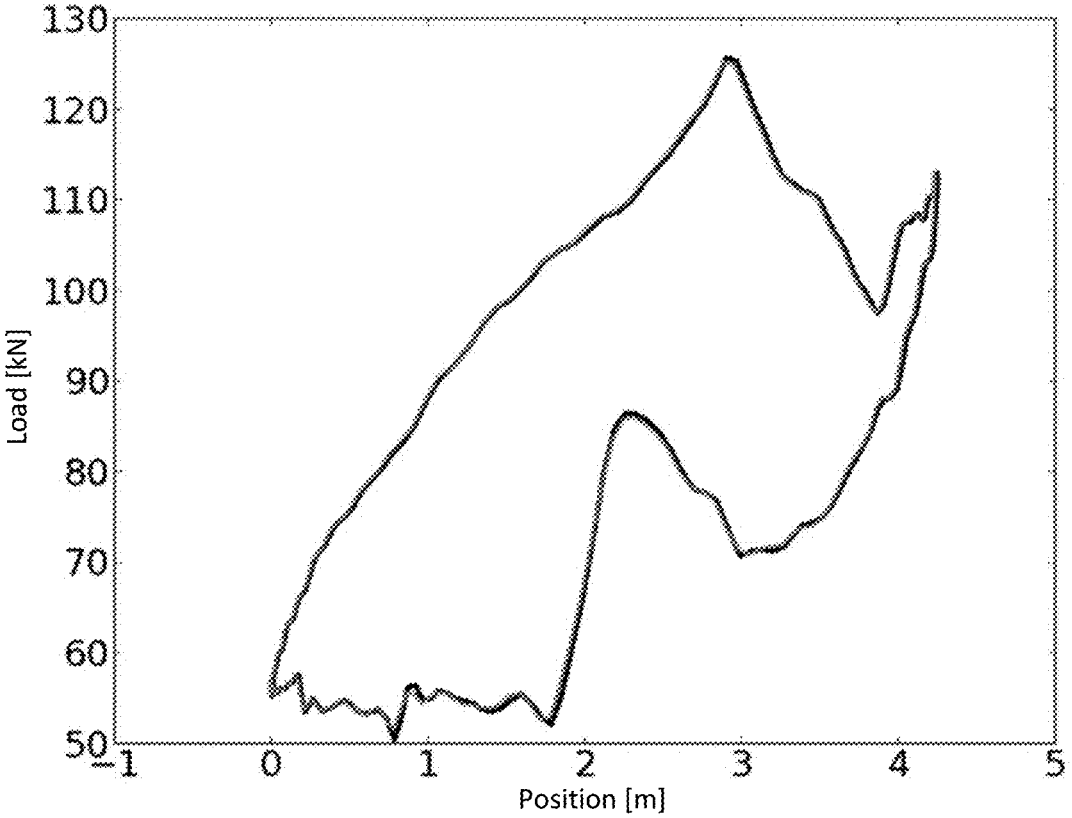
FIGS. 21A and 21B show an example where the hybrid method enables the correction of the numerical noise in the diagnostic method when the sign factor is $\alpha$=0.01.
Figure 21B:
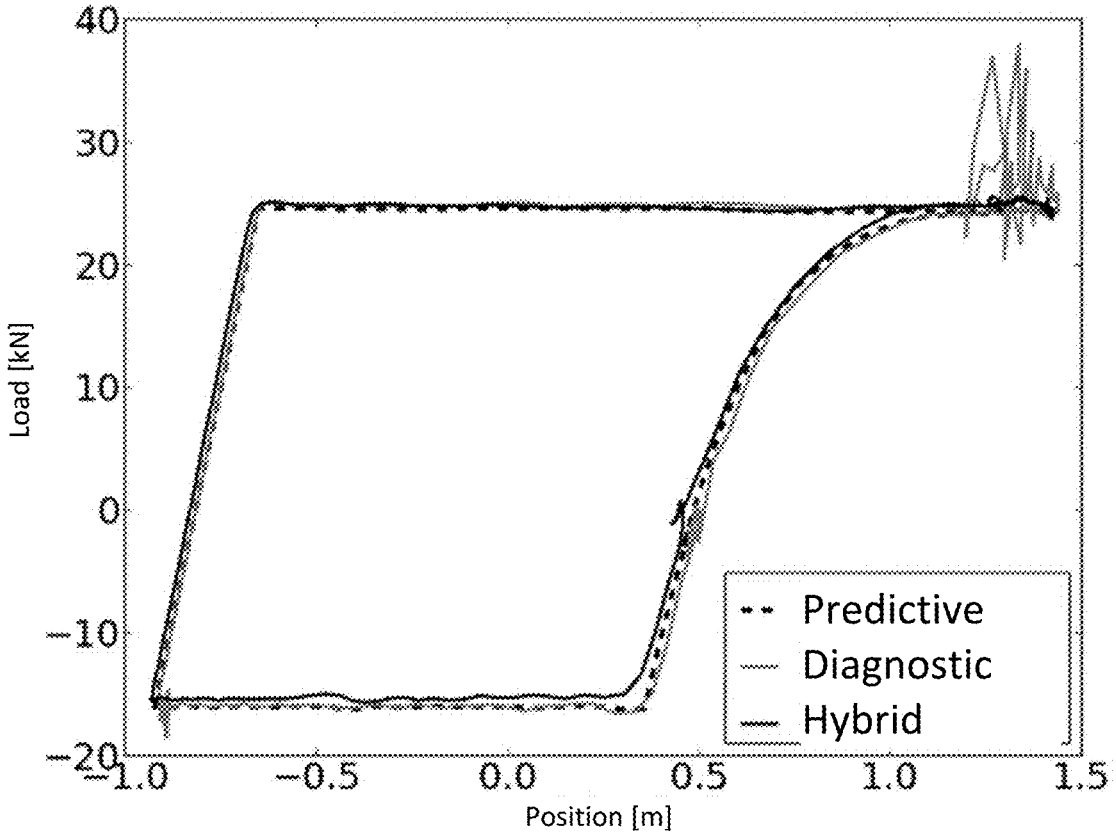

When the hybrid method is applied to cases that present noise for the diagnostic mode of the previous section, it enables solving the aforementioned difficulties. In FIG. 21A, a black line shows the surface data of the S-shaped well for a direct simulation, while a gray line shows the card adjusted by the hybrid method. FIG. 21B shows how the noise can be eliminated by taking the output of the method in diagnostic mode as the initial condition for the method in hybrid mode. For this case, the method in diagnostic mode presents noise using $\alpha=0.01$, where such iterations of the hybrid method enable maintaining the surface fit while filtering the bottom data using $\alpha=1$.

The invention claimed is:

1. A method for determining a stress profile in an oil well pumping system comprising a sucker rod string operated by a polished rod, based on an axial position of the sucker rod string, where the method comprises the following steps:

a) obtaining a measurement of a position of the polished rod at the surface, b) obtaining a measurement of a force on a downhole pump, c) calculating a value of a force on the polished rod at the surface by numerically solving a system of equations representative of a pumping system in a natural generalized coordinates system using measurements of the position of the polished rod at the surface and the force on the downhole pump, d) calculating stresses at each axial position of the rod string from the measurement of the force on the downhole pump and the value of the force on the polished rod at the surface calculated in step c), and e) associating to each stress calculated in step d) the corresponding axial position of the sucker rod string in order to obtain the stress profile.

2. The method according to claim 1, where the system of equations representative of the pumping system in a natural generalized coordinates system is the system of equations {(15), (16)}:

$$m_i\frac{d^2s_i}{dt^2} = \vec{f}^{+}_{r,i}\cdot\hat{\tau}_i + \vec{f}^{-}_{r,i}\cdot\hat{\tau}_i + m_i\vec{g}\cdot\hat{\tau}_i + \vec{f}^{c}_i\cdot\hat{\tau}_i + \vec{f}^{v}_i\cdot\hat{\tau}_i + \vec{f}^{p}_i\cdot\hat{\tau}_i (i = 1, 2, \ldots, N) \quad (15)$$

$$0 = \vec{f}^{+}_{r,i}\cdot\hat{n}_i + \vec{f}^{-}_{r,i}\cdot\hat{n}_i + m_i\vec{g}\cdot\hat{n}_i + \vec{N}_i (i = 1, 2, \ldots, N) \quad (16)$$

where, for each of the elements i, $s_i(t)$ the generalized coordinate corresponding to the center position of the element, t a time variable, $m_i$ the mass of the element, $\vec{f}_{r,i}^{+}$ the elastic force exerted on the element by the i+1 neighbor element, $\vec{f}_{r,i}^{-}$ the elastic force exerted on the element by the i−1 neighbor element, $\hat{\tau}_i$ the tangential versor at the point $s_i(t)$, $\vec{g}$ the acceleration vector of the gravitational field, $\vec{f}_i^{c}$ the Coulomb force exerted on the element, $\vec{f}_i^{v}$ the viscous force exerted on the element, $\vec{f}_i^{p}$ the force exerted on the element due to section changes, $\vec{N}_i$ is the normal force exerted on the element and $\hat{n}_i$ is the normal versor at the point $s_i(t)$.

3. The method according to claim 1, which also comprises the steps of:

f) comparing the profile of axial stress obtained in step e) with a reference axial stress profile, and g) modifying an operating parameter of the pumping system based on the comparison made in step f).

4. The method according to claim 1, which also comprises the calculation of the work per cycle of the pumping system.

5. The method according to claim 1, which also comprises the calculation of the number of stucking events per cycle of the pumping system.

6. A method for diagnosing an operation of an oil well pumping system comprising a sucker rod string driven by a polished rod, where the method comprises the following steps:

a) obtaining a measurement of a position of the polished rod at the surface, b) obtaining a measurement of a force on the polished rod at the surface, c) calculating a value of a force on a downhole pump by numerically solving a system of equations representative of the pumping system in a natural generalized coordinates system using measurements of the position of the polished rod and the force on the polished rod at the surface, comprising finding the zero of the function R defined by equation (32):

$$R(s_{i+1}(t)) = -m_i d^2s_i/dt + \vec{f}_{r,i}^{+}\cdot\hat{\tau}_i + \vec{f}_{r,i}^{-}\cdot\hat{\tau}_i + m_i\vec{g}\cdot\hat{\tau}_i + \hat{f}_i^{c}\cdot\hat{\tau}_i + \vec{f}_i^{v}\cdot\hat{\tau}_i + \vec{f}_i^{p}\cdot\hat{\tau}_i \ (i=1,2,\ldots,N-1) \quad (32)$$

for each of the elements i, being $s_i(t)$ the generalized coordinate corresponding to the center position of the element, t a time variable, $m_i$ the mass of the element, $\vec{f}_{r,i}^{+}$ the elastic force exerted on the element by the i+1 neighbor element, $\vec{f}_{r,i}^{-}$ the elastic force exerted on the element by the i−1 neighbor element, $\hat{\tau}_i$ the tangential versor at the points $s_i(t)$, $\vec{g}$ the acceleration vector of the gravitational field, $\vec{f}_i^{c}$ the Coulomb force exerted on the element, $\vec{f}_i^{v}$ the viscous force exerted on the element, and $\vec{f}_i^{p}$ the force exerted on the element due to section changes, and d) obtaining a diagnosis of an operation of the pumping system from the value of the downhole force calculated in step c).

7. The method according to claim 6, where step d) of obtaining a diagnosis of the operation of the pumping system from the value of the force on the downhole pump comprises determining a pressure at the pump inlet $p_i$ from equation (36):

$$p_I = P_D - \frac{f_0}{A_B} \quad (36)$$

being $f_0$ the range of force of a downhole card obtained from step c) of the method of claim 6, $p_D$ a pressure at a pump discharge and $A_B$ the area of the pump.

8. A device for monitoring an operation of an oil well pumping system comprising a sucker rod string driven by a polished rod, where such device comprises, in a single housing or enclosure:

at least one data acquisition unit, at least one source of energy and at least one processing unit, where this data acquisition unit obtains a measurement of a position of the polished rod at the surface and a measurement of a force on a downhole pump and such processing unit calculates a value of a force on the polished rod at the surface by numerically solving a system of equations representative of a pumping system in a natural generalized coordinates system using the measurements of the polished rod position at the surface and the downhole pump force.

* * * * *